US010799925B2

(12) United States Patent
Nakamura et al.

(10) Patent No.: US 10,799,925 B2
(45) Date of Patent: Oct. 13, 2020

(54) EDGING METHOD AND EDGING DEVICE

(71) Applicant: NIPPON STEEL & SUMITOMO METAL CORPORATION, Tokyo (JP)

(72) Inventors: Yoji Nakamura, Tokyo (JP); Toshiaki Saitoh, Tokyo (JP); Satoru Mashiko, Tokyo (JP); Tetsuo Kishimoto, Tokyo (JP); Akihisa Tsuruta, Tokyo (JP); Tatsuya Nakada, Tokyo (JP); Naoki Kataoka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 388 days.

(21) Appl. No.: 15/542,206

(22) PCT Filed: May 13, 2016

(86) PCT No.: PCT/JP2016/064391
§ 371 (c)(1),
(2) Date: Jul. 7, 2017

(87) PCT Pub. No.: WO2017/195373
PCT Pub. Date: Nov. 16, 2017

(65) Prior Publication Data

US 2018/0214919 A1 Aug. 2, 2018

(51) Int. Cl.
*B21B 37/22* (2006.01)
*B21B 39/14* (2006.01)
(Continued)

(52) U.S. Cl.
CPC ..... *B21B 37/22* (2013.01); *B21B 1/02* (2013.01); *B21B 1/024* (2013.01); *B21B 15/00* (2013.01);
(Continued)

(58) Field of Classification Search
CPC ..... B21B 37/22; B21B 37/68; B21B 39/14; B21B 1/02; B21B 1/024; B21B 15/00
See application file for complete search history.

(56) References Cited

U.S. PATENT DOCUMENTS 4,063,076 A * 12/1977 Morooka ..... B21B 37/22 700/153
5,634,360 A * 6/1997 Tazoe ..... B21B 39/14 72/12.5
(Continued)

FOREIGN PATENT DOCUMENTS

DE 102012224505 A1 7/2014
JP 55-61304 A 5/1980
(Continued)

OTHER PUBLICATIONS

EPO Machine Translation of JP2794875 (Year: 2019).*
(Continued)

*Primary Examiner* — Pradeep C Battula
(74) *Attorney, Agent, or Firm* — Birch, Stewart, Kolasch & Birch, LLP

(57) ABSTRACT

An edging method including changing an incident angle of a slab with respect to a pair of edging members that are disposed on a conveyance line of the slab and that edge the slab based on information relating to the slab acquired at at least one of prior to edging or after edging.

3 Claims, 17 Drawing Sheets

(51) Int. Cl.

| | |
|---|---|
| ***B21B 1/02*** | (2006.01) |
| ***B21B 15/00*** | (2006.01) |
| *B21B 39/16* | (2006.01) |
| *B21B 37/68* | (2006.01) |

(52) U.S. Cl.
CPC ..... *B21B 39/14* (2013.01); *B21B 15/0035* (2013.01); *B21B 37/68* (2013.01); *B21B 39/16* (2013.01); *B21B 2261/06* (2013.01); *B21B 2261/21* (2013.01); *B21B 2263/12* (2013.01)

(56) References Cited

U.S. PATENT DOCUMENTS

| | | | | |
|---|---|---|---|---|
| 8,429,943 | B2 * | 4/2013 | Jepsen | B21B 39/14 72/10.4 |
| 8,490,447 | B2 * | 7/2013 | Kurz | B21B 37/28 72/8.1 |
| 9,616,474 | B2 * | 4/2017 | Schilling | B21B 39/14 |
| 2010/0218576 | A1 | 9/2010 | Felkl | |
| 2010/0269556 | A1 | 10/2010 | Moretto et al. | |
| 2012/0096914 | A1 * | 4/2012 | Seidel | B21B 39/14 72/250 |
| 2015/0328669 | A1 * | 11/2015 | Schilling | B21B 37/22 72/12.8 |

FOREIGN PATENT DOCUMENTS

| | | | | |
|---|---|---|---|---|
| JP | 61-222602 | A | 10/1986 | |
| JP | 62-96943 | U | 6/1987 | |
| JP | 1-96208 | U | 6/1989 | |
| JP | 3-230803 | A | 10/1991 | |
| JP | 3-230804 | A | 10/1991 | |
| JP | 3-254301 | A | 11/1991 | |
| JP | 8-132117 | A | 5/1996 | |
| JP | 9-29301 | A | 2/1997 | |
| JP | 2794875 | B2 * | 9/1998 | B21B 37/68 |
| JP | 2001-113338 | A | 4/2001 | |
| JP | 2001-179301 | A | 7/2001 | |
| JP | 2014-76465 | A | 5/2014 | |
| JP | 2016-78057 | A | 5/2016 | |
| RU | 2448790 | C2 | 4/2012 | |
| RU | 2449846 | C2 | 5/2012 | |

OTHER PUBLICATIONS

EPO Machine Translation of JP 2001179301 (Year: 2019).*
Russian Office Action, dated Aug. 29, 2018, for corresponding Russian Application No. 2017130614/02(053325), with an English translation.
Extended European Search Report, dated Oct. 2, 2018, for European Application No. 16886822.2.
International Search Report for PCT/JP2016/064391 (PCT/ISA/210) dated Jun. 7, 2016.
Written Opinion of the International Searching Authority for PCT/JP2016/064391 (PCT/ISA/237) dated Jun. 7, 2016.
Notice of Opinion of Examination dated Sep. 13, 2017, in Taiwan Patent Application No. 105115024, with English translation.

* cited by examiner

EDGING METHOD AND EDGING DEVICE

TECHNICAL FIELD

The present disclosure relates to an edging method and an edging device.

BACKGROUND ART

In a rough rolling procedure of a hot rolling process, sometimes bending deformation, referred to as camber, occurs in a steel strip. One cause of camber of the steel strip during the rough rolling procedure is temperature variation that arises inside a heating furnace across the width direction of a slab.

Japanese Patent Application Laid-Open (JP-A) No. H03-254301 describes technology in which, in cases in which a temperature variation is present across the width direction of a slab, a pair of dies are moved relatively in a conveyance line direction, and a pair of side guides upstream on a conveyance line are moved aligned with a conveyance line center of an edging device, thereby suppressing camber.

Japanese Utility Model Application Laid-Open (JP-U) No. S62-96943 describes technology in which a guide device with guide rolls is provided at a slab entry side or a slab exit side of a sizing press. Camber is suppressed by restraining the slab such that a center position in the width direction of the slab and a center position in the width direction of the sizing press are aligned with each other.

SUMMARY OF INVENTION

Technical Problem

In the technology described in JP-A No. H03-254301, although camber of the slab is suppressed at the exit side of the edging device, a slab thickness variation (asymmetry in the slab thickness distribution) arises in both lateral face portions in a width direction in the slab cross-section, so as to form a dog-bone profile.

In the method described in JP-U No. S62-96943, camber of the slab on the exit side of the press is not suppressed in cases in which temperature variation arises in the slab width direction. Moreover, a slab thickness variation (asymmetry in the slab thickness distribution) arises in both lateral face portions in a width direction in the slab cross-section.

Even if camber does not occur after pressing, if a slab thickness variation (asymmetry in the slab thickness distribution) is present between the both lateral face portions in a width direction in the slab cross-section, during later rolling by horizontal rolls, the slab thickness stretches further in the length direction at the side with the thicker slab thickness than at the side with the thinner slab thickness. This results in the occurrence of camber in the slab.

In consideration of the above circumstances, an object of the present disclosure is to suppress the occurrence of camber in a slab during an edging process of the slab during a rough rolling procedure of a hot rolling process.

Solution to Problem

An edging method of the present disclosure includes changing an incident angle of a slab with respect to a pair of edging means that are disposed on a conveyance line of the slab and that edge the slab based on information relating to the slab acquired at at least one of prior to edging or after edging.

An edging device of the present disclosure includes a pair of edging means that are disposed on a conveyance line of a slab, and that perform edging by pressing the slab from both sides in the width direction of the slab; a slab incident angle changing means that is disposed further upstream than the pair of edging means on the conveyance line, and that changes an incident angle of the slab; a slab information acquisition means that acquires information relating to the slab at at least one of prior to edging or after edging; and a slab incident angle control means that controls the slab incident angle changing means based on information relating to the slab acquired by the slab information acquisition means.

Advantageous Effects of Invention

The present disclosure enables camber to be suppressed from occurring in a slab that has undergone an edging process of the slab during a rough rolling procedure of a hot rolling process.

DESCRIPTION OF EMBODIMENTS

Explanation follows regarding an edging method and an edging device according to exemplary embodiments of the present disclosure, with reference to the drawings.

First Exemplary Embodiment

Figure 1:
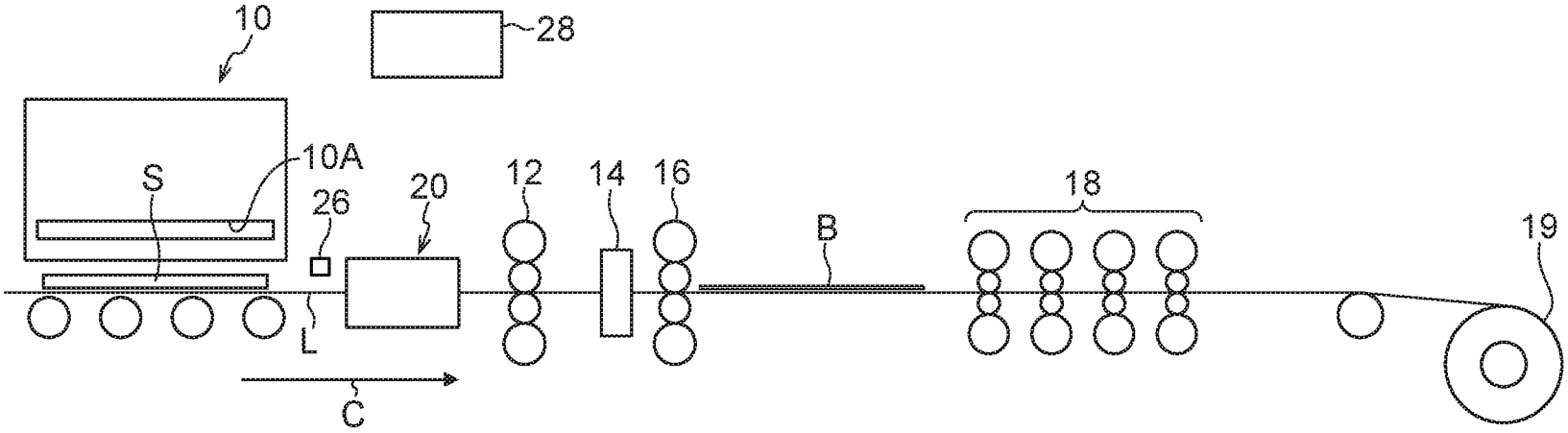
FIG. 1 is a schematic configuration diagram of a rough rolling procedure of a hot rolling process employing an edging method and an edging device of a first exemplary embodiment.

Before going on to explain an edging method and an edging device of a first exemplary embodiment, explanation is given regarding a steel strip hot rolling process, with reference to FIG. 1.

Hot Rolling Process

As illustrated in FIG. 1, during a rough rolling procedure in a steel strip hot rolling process, first, a slab S that has been heated to a specific temperature in a heating furnace 10 is discharged from a discharge port 10A of the heating furnace 10, and is placed on a conveyance line L. The conveyance line L is a path for conveying the slab S discharged through the discharge port 10A downstream in a conveyance direction (the direction illustrated by arrow C in FIG. 1), and is, for example, configured by a roller conveyor, or a belt conveyor with excellent heat resistance. Note that the conveyance line L is not limited to the above conveyors, as long as the slab S can be conveyed.

Next, the slab S that has been discharged from the heating furnace 10 is applied with pressure in the width direction (this is referred to as "edging" as appropriate hereafter) by an edging device 20 of the present exemplary embodiment. The slab S that has been subjected to edging by the edging device 20 is conveyed downstream along the conveyance line L to a horizontal rolling mill 12.

The slab S that has been conveyed to the horizontal rolling mill 12 is applied with pressure in the slab thickness direction (the direction illustrated by the arrow T in FIG. 11 and FIG. 12) by horizontal rolling mill 12 (this is referred to as "thickness rolling" as appropriate hereafter).

The thickness rolled slab S is moved repeatedly between vertical rolls 14 further downstream on the conveyance line L than the horizontal rolling mill 12, and horizontal rolls 16 further downstream than the vertical rolls 14, such that fine edging by the vertical rolls 14 and thickness rolling by the horizontal rolls 16 is performed repeatedly. In this manner, the slab S is formed into a semi-finished product, for example with a strip thickness of approximately 40 mm, referred to as a rough bar B.

The rough bar B is then sent for a finishing rolling procedure of the hot rolling process, in which plural horizontal rolls 18 (four in the present exemplary embodiment) perform finishing rolling on the rough bar B, which is then taken up onto a coiler 19.

Edging Device

Next, explanation follows regarding the edging device of the present exemplary embodiment.

Figure 2:
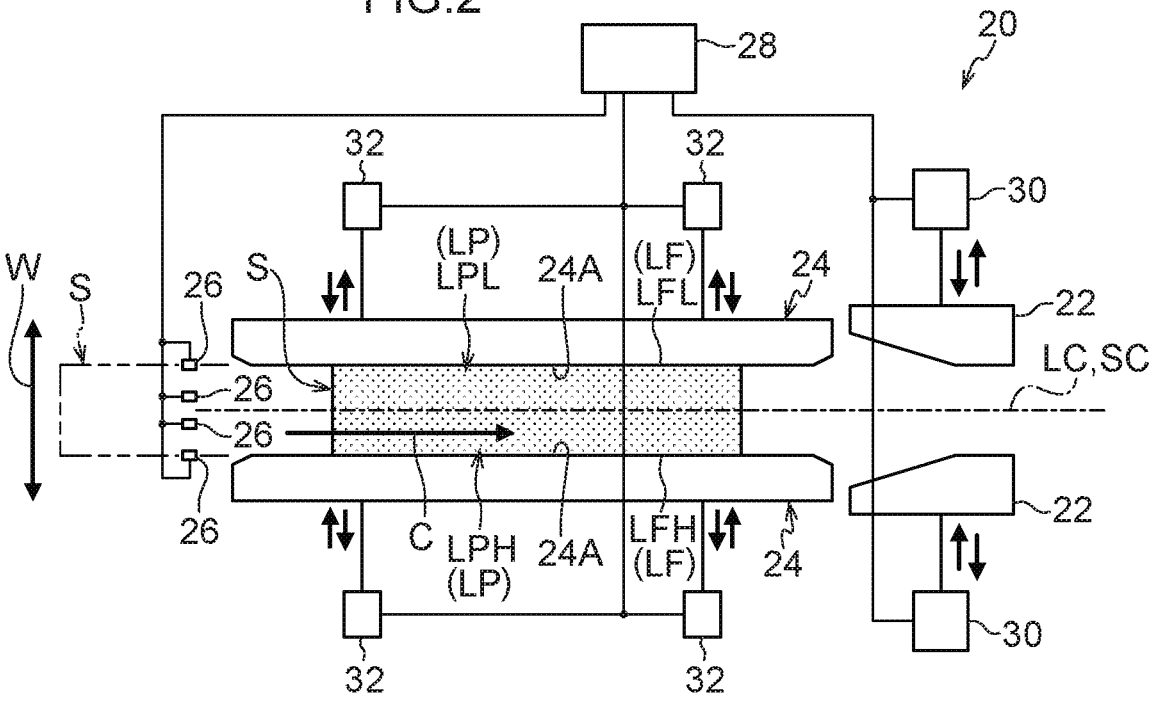
FIG. 2 is a plan view schematically illustrating an edging device of the first exemplary embodiment.

As illustrated in FIG. 2, the edging device 20 is a device that edges the slab S that has been discharged from the heating furnace 10 in the rough rolling procedure. The edging device 20 includes a pair of edging members 22, serving as an example of a pair of edging means, a pair of plate members 24, serving as an example of a slab incident angle changing means, temperature sensors 26, serving as an example of a slab information acquisition means, and a controller 28, serving as an example of a slab incident angle control means. Note that the controller 28 and the temperature sensors 26 are omitted from illustration in FIG. 4 to FIG. 8.

The pair of edging members 22 are disposed on the conveyance line L of the slab S, and are configured to perform edging by pressing the slab S from both sides in the width direction of the slab S. Specifically, the edging members 22 are capable of being moved in the width direction of the conveyance line L (this being the same direction as the width direction of the slab S prior to edging (the direction indicated by arrow W in FIG. 2)) by pressing mechanisms 30. The pair of edging members 22 perform edging by repeatedly pressing the slab S from both sides in the width direction with a pressing force from the pressing mechanisms 30. The pressing mechanisms 30 are controlled by the controller 28, described later. Note that examples of the pressing mechanisms 30 include mechanisms employing electric motors, and mechanisms employing hydraulic cylinders or the like.

The pair of plate members 24 are disposed upstream of the pair of edging members 22 on the conveyance line L, and are guides that extend along the conveyance line L toward the pair of edging members 22. The plate members 24 are capable of being moved in the width direction of the conveyance line L, and are capable of being tilted toward a conveyance line center LC (the center in the width direction of the conveyance line L), by moving mechanisms 32. Moreover, the pair of plate members 24 are capable of sandwiching the slab S from both sides in the width direction with movement force from the moving mechanisms 32 so as to adjust the position of the slab S in the width direction of the conveyance line L, and to adjust the incident angle θ (described in detail later) of the slab S with respect to the conveyance line center LC. The moving mechanisms 32 are controlled by the controller 28, described later. Note that examples of the moving mechanisms 32 include mechanisms employing electric motors, and mechanisms employing hydraulic cylinders or the like. Plate faces 24A of the plate members 24 on the inner side in the width direction of the conveyance line L (the center side of the conveyance line center LC) abut lateral faces LF in the width direction of the slab S.

Plural of the temperature sensors 26 are disposed across the width direction of the conveyance line L between the heating furnace 10 and the edging device 20. The temperature sensors 26 measure the temperature (surface temperature) of the slab S prior to edging. Temperature information (a temperature distribution) measured by the plural temperature sensors 26 is sent to the controller 28.

Based on the temperature distribution across the width direction of the slab S sent from the plural temperature sensors 26, the controller 28 actuates the moving mechanisms 32 so as to control the positions of the pair of plate members 24 in the width direction of the conveyance line L, and control the angles of the pair of plate members 24 with respect to the conveyance line center LC, respectively. Specifically, according to the temperature variation across the width direction of the slab S, the controller 28 controls the moving mechanisms 32 such that a rear end of a lateral face LFL on the side where the temperature of the slab S is lower (referred to below as the "low temperature side" as appropriate) is moved away from the conveyance line center LC. The plate members 24 accordingly move in the width direction of the conveyance line L, and tilt with respect to the conveyance line center LC so as to apply the slab S with an incident angle θ. Note that the "incident angle θ of the slab S" referred to here indicates an incident angle of the slab S with respect to the pair of edging members 22 (the angle of a slab center SC with respect to the conveyance line center LC).

The controller 28 is also sent information relating to, for example, the slab edging method, the dimensions of the slab S, the edging amount of the slab S, and the type of steel of the slab S, in addition to the temperature information for the slab S. This information may be input by an operator via an external input device, or may be acquired by some other method. The controller 28 may change the incident angle θ based on information related to at least one of the slab edging method, the dimensions of the slab S, the edging amount of the slab S, and the type of steel of the slab S, in addition to the temperature information for the slab S. In other words, the incident angle θ may be determined based on the temperature distribution and at least one other piece of information.

Plural position sensors (for example optical sensors), not illustrated in the drawings, are provided on the conveyance line L to detect the position of the slab S, and send position information relating to the slab S on the conveyance line L to the controller 28.

Edging Method

Next, explanation follows regarding the edging method according to the first exemplary embodiment. Note that the edging method of the present exemplary embodiment employs the edging device 20.

First, the temperature of the heated slab S discharged through the discharge port 10A of the heating furnace 10 is measured by the plural temperature sensors 26, and the measured temperature information (temperature distribution) is sent to the controller 28.

Figure 3:
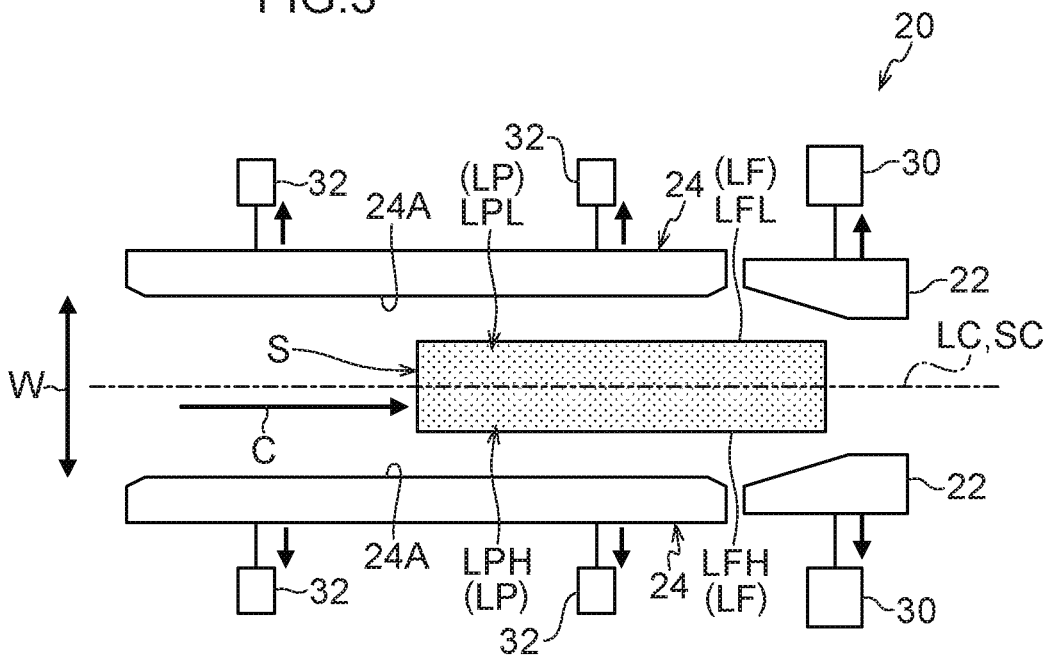
FIG. 3 is a plan view illustrating a state prior to edging of a slab in an edging device of the first exemplary embodiment.

Next, as illustrated in FIG. 2, the slab S is sandwiched from both sides by the pair of plate members 24, and the position in the width direction of the slab center SC is aligned with the width direction position of the conveyance line center LC (known as "centering"). Then as illustrated in FIG. 3, the pair of plate members 24 are moved toward the outer sides in the width direction of the conveyance line L (sides going away from the conveyance line center LC), such that the pair of plate members 24 separate from the slab S.

Figure 4:
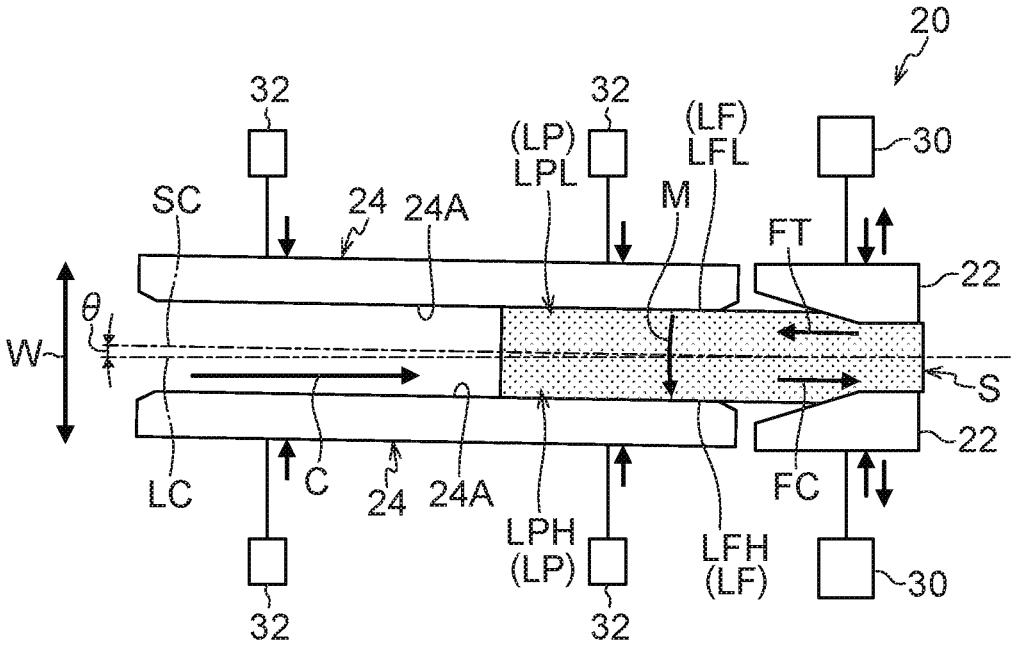
FIG. 4 is a plan view illustrating a state following on from FIG. 3, in which a trailing end side of the slab sandwiched between a pair of plate members is moved in a width direction of the conveyance line to apply an incident angle to the slab, while edging a leading end side of the slab.
Figure 5:
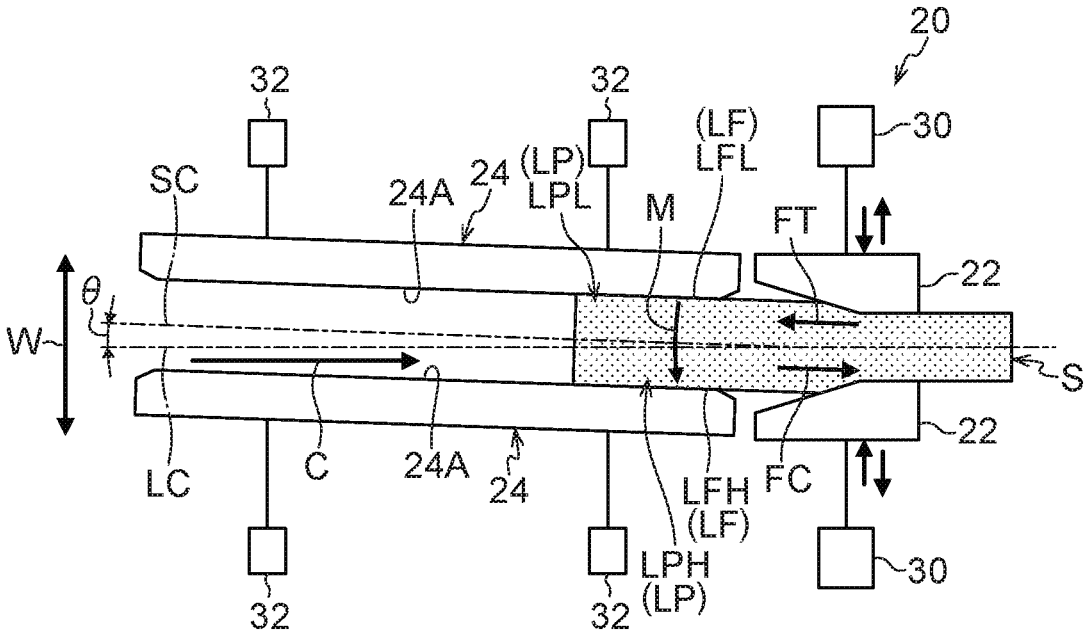
FIG. 5 is a plan view illustrating a state in which the trailing end side of the slab has moved further in the width direction of the conveyance line than in the state illustrated in FIG. 4, thereby increasing the incident angle.

Next, based on the acquired temperature information, the controller 28 controls the moving mechanisms 32 so as to apply the incident angle θ to the slab S in cases in which a temperature variation is present across the width direction of the slab S. Specifically, as illustrated in FIG. 4 to FIG. 6, the slab S is again sandwiched from both sides in the width direction s by the pair of plate members 24, and in this state, the slab S is applied with the incident angle θ such that the rear end of the lateral face LFL on the low temperature side of the slab S (the lateral face of the slab S on the top side in FIG. 4 to FIG. 6) moves away from the conveyance line center LC. Note that in the present exemplary embodiment, the incident angle θ is set according to the temperature variation across the width direction of the slab S, and a progress status of the edging of the slab S. Specifically, during edging of a leading end portion of the slab S (see FIG. 4), hardly any camber occurs, and so the incident angle θ is set to zero, or a value close to zero. As the edging progress status of the slab S (in other words the position in the length direction of the slab S up to which edging has been performed) progresses, the incident angle θ is made larger (see FIG. 5 and FIG. 6). As edging of a trailing end of the slab S approaches, the incident angle θ is reduced (see FIG. 7), and during edging of the trailing end of the slab S, the incident angle θ is set to zero, or a value close to zero (see FIG. 8). Moreover, the amount by which the incident angle θ is increased is set so as to become greater the larger the temperature variation across the width direction of the slab S. Note that the edging progress status of the slab S is computed based on position information of the slab S from the position sensors described above.

The incident angle θ is preferably changed based on at least one piece of information out of the edging method of the slab S, the dimensions of the slab S, the edging amount of the slab S, or the type of steel of the slab S, in addition to the temperature information of the slab S. Setting the incident angle θ based on such information relating to the slab S in addition to the temperature information of the slab S enables a more appropriate incident angle θ to be obtained for the slab S.

Figure 7:
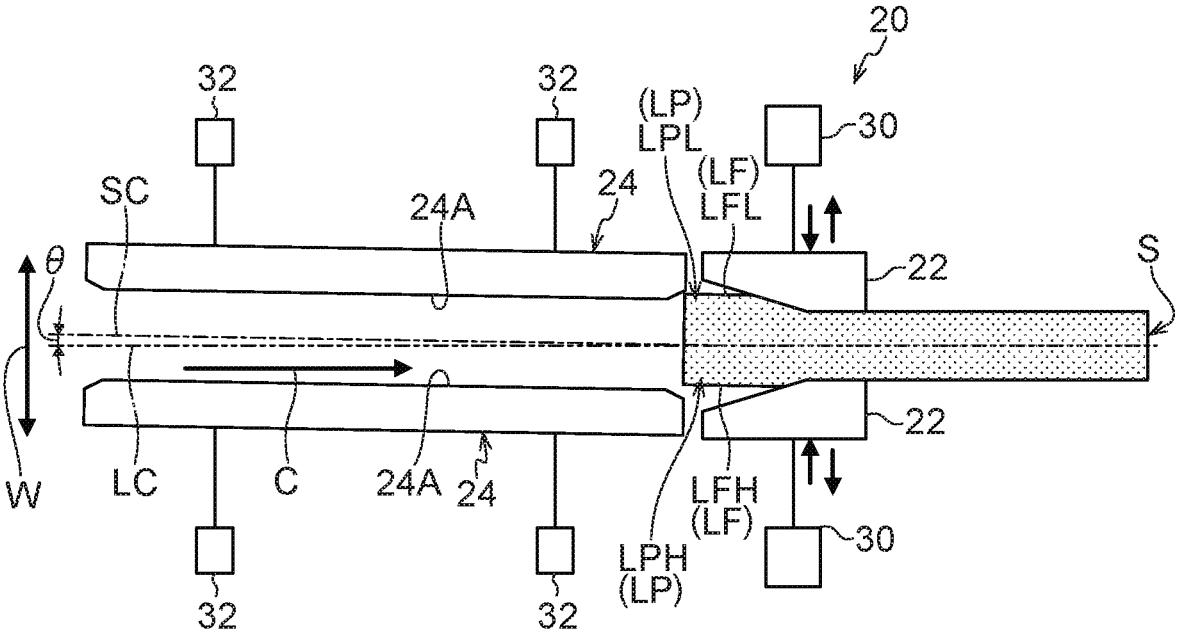
FIG. 7 is a plan view illustrating a state in which the trailing end side of the slab is being edged.
Figure 8:
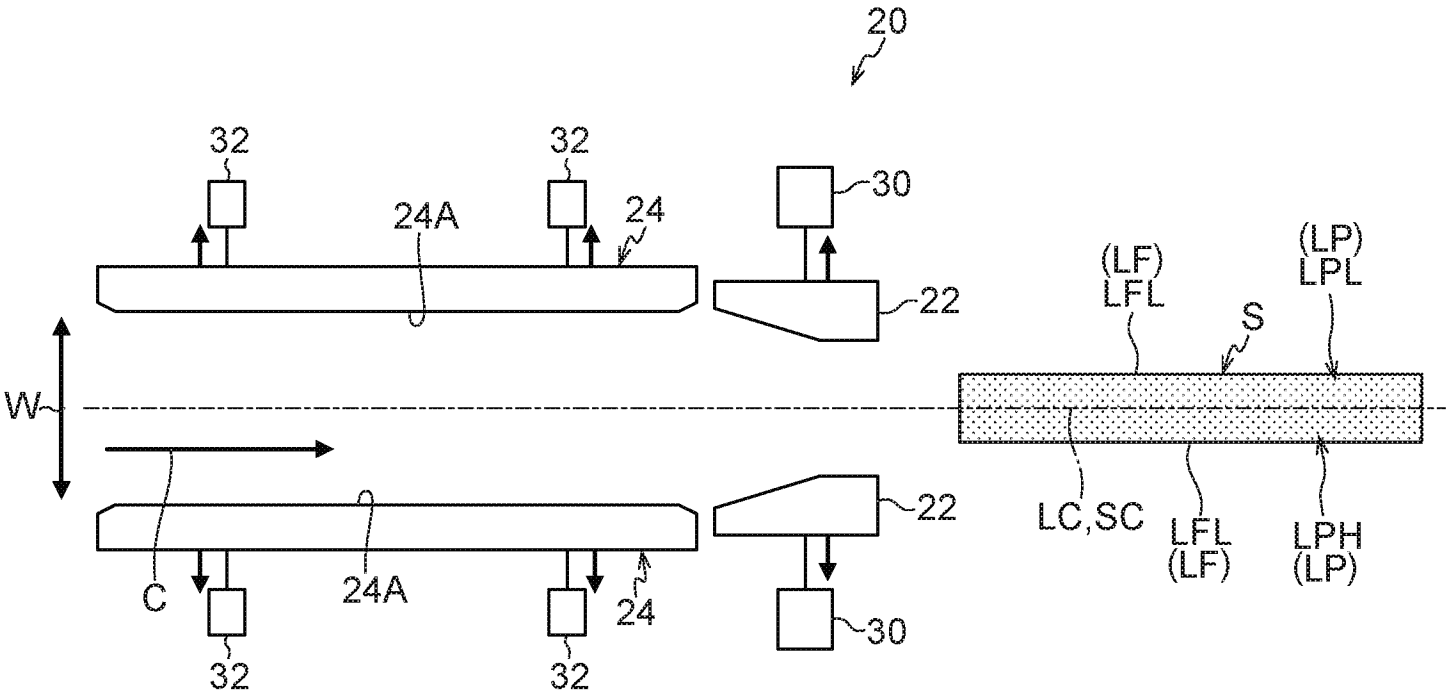
FIG. 8 is a plan view illustrating a state in which the edged slab has moved downstream of an edging member along the conveyance line.

After the slab S has moved downstream of the pair of plate members 24 along the conveyance line L, as illustrated in FIG. 7, the controller 28 operates the moving mechanisms 32 to return the positions in the width direction of the plate members 24 to their original positions, and to return the tilt of the plate members 24 with respect to the conveyance line center LC back to the original tilt. Then, as illustrated in FIG. 8, the pair of plate members 24 adopt a standby state in a state at a separation from the conveyance line L in the width direction.

Note that in cases in which temperature variation across the width direction of the slab S is not present (or is a permissible lower limit value), the controller 28 keeps the pair of plate members 24 in a state separated from the slab S (the state illustrated in FIG. 3). Accordingly, the slab S passes straight through between the plate members 24 and is subjected to edging by the pair of edging members 22.

Next, explanation follows regarding operation and advantageous effects of the first exemplary embodiment.

Figure 11:
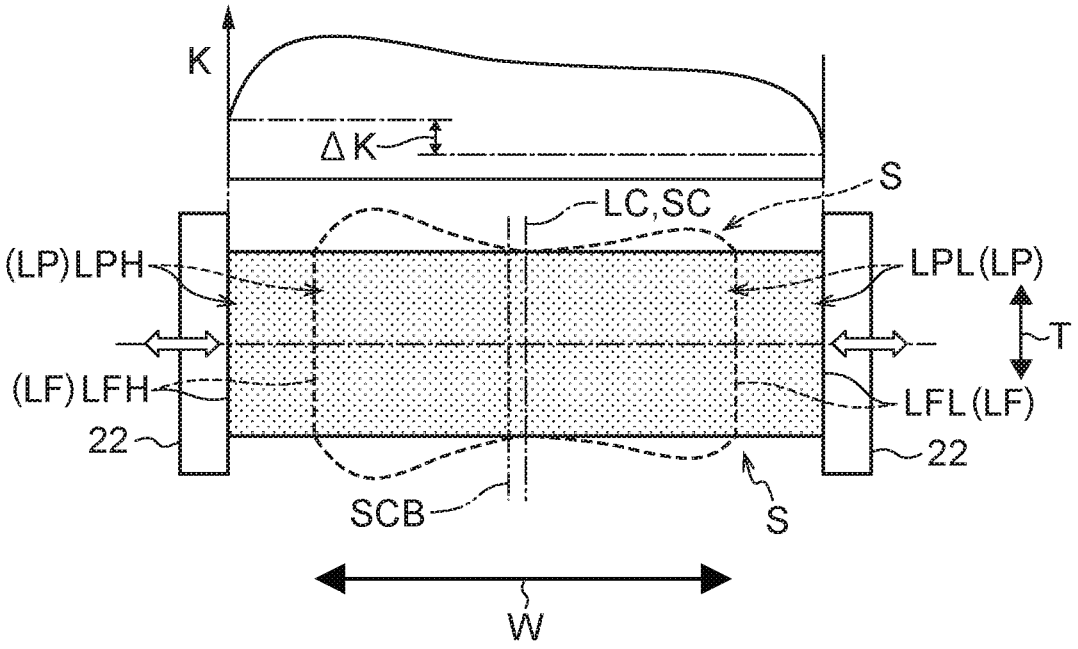
FIG. 11 is a schematic diagram illustrating a cross-section profile of a slab prior to edging, and a temperature distribution across the slab width direction.
Figure 12:
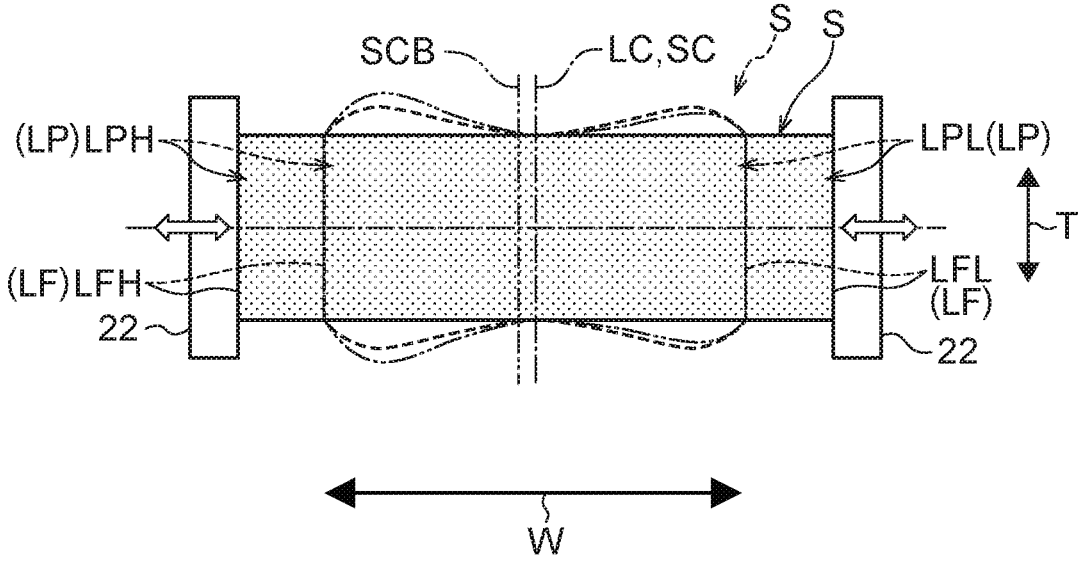
FIG. 12 is a schematic diagram illustrating a cross-section profile of a slab after edging.

First, explanation follows regarding edging methods of the slab S in Comparative Examples 1 and 2, which are not included within the scope of the present disclosure. Explanation will then be given regarding how the operation and advantageous effects thereof differ from those of the present exemplary embodiment. In the following explanation, as illustrated in FIG. 11, explanation follows regarding a case in which a temperature variation is present across the width direction of the slab S. Note that in FIG. 11, the vertical axis K indicates the temperature of the slab S, and the temperature difference between both edges in the width direction of the slab S is indicated by the temperature variation AK.

Figure 9:
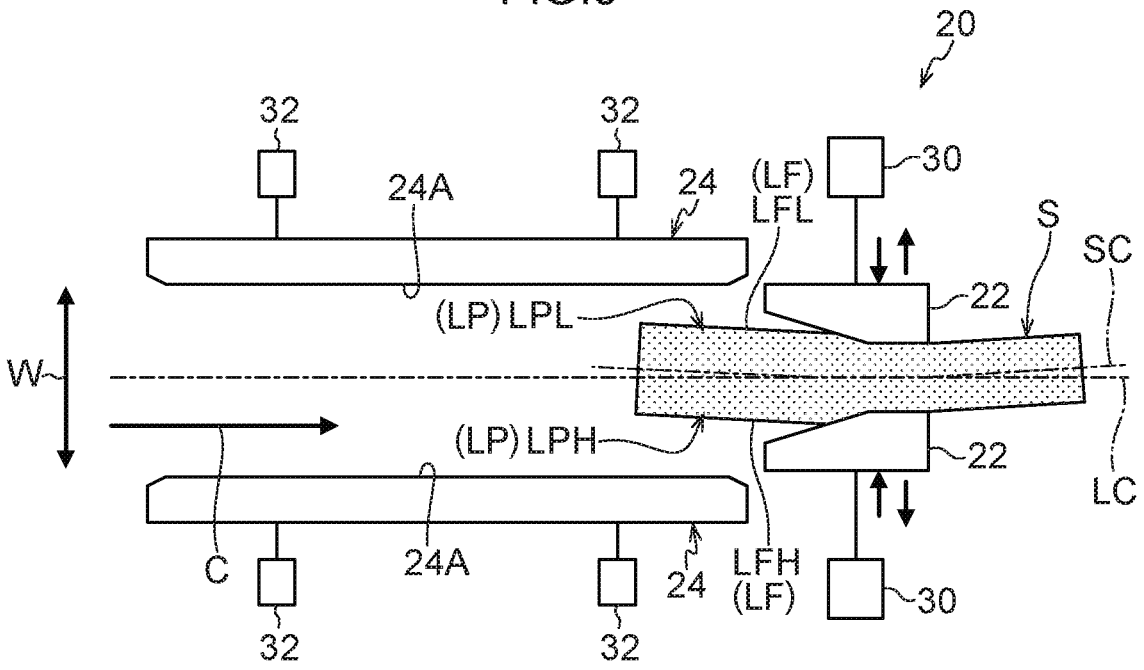
FIG. 9 is a plan view illustrating a state in which a slab is being edged using an edging method of Comparative Example 1.

In Comparative Example 1, as illustrated in FIG. 9, the position in the width direction of the slab center SC of the slab S is aligned with the position in the width direction of the conveyance line center LC by the pair of plate members 24, after which edging of the slab S is performed in a state in which the pair of plate members 24 have been moved away from the slab S (in a non-restrained state). In the edging method of Comparative Example 1, the slab S is edged by moving the pair of edging members 22 to and fro symmetrically about the conveyance line center LC. When this is performed, both lateral face portions LP deform to a greater extent and attain a greater slab thickness than a central portion in the width direction of the slab S, such that the slab S is deformed into what is referred to as a dog-bone profile. In cases in which there is no temperature variation across the width direction of the slab S, the cross-section profile of the slab S is symmetrical about the slab center SC, and camber does not occur. However, if a temperature variation is present across the width direction of the slab S, out of the two lateral face portions LP of the slab S, the lateral face portion LPH on the side with the higher temperature (referred to below as the "high temperature side") has lower resistance to deformation than the lateral face portion LPL on the low temperature side, and deforms more readily. Accordingly, even if both plate members 24 move by the same amount, the lateral face portion LPH on the high temperature side of the slab S deforms by a greater amount in the width direction than the lateral face portion LPL on the low temperature side. Namely, as illustrated in FIG. 11, after edging, the slab center SC (a line bisecting the slab S along the width dimension) that, prior to edging, was aligned with the conveyance line center LC, moves toward the lateral face portion LPH on the high temperature side, resulting in the SCB indicated by the double-dotted dashed lines.

When this occurs, the lateral face portion LPH on the high temperature side of the slab S deforms more readily than the lateral face portion LPL on the low temperature side, and so the slab thickness also increases (see the dashed lines in FIG. 11). Accordingly, the cross-section profile of the slab S after undergoing the edging process (see the dashed lines in FIG. 11) is not symmetrical about the slab center SC (or the slab center SCB). Namely, thickness variation occurs between the two lateral face portions LP of the slab S.

Moreover, the variation in deformation of the slab S is expressed as length direction elongation of the slab S. Specifically, the length direction elongation of the slab S is greater at the lateral face portion LPH on the high temperature side of the slab S, and the length direction elongation of the slab S is smaller at the lateral face portion LPL on the low temperature side of the slab S. Accordingly, the slab S bends such that a lateral face LFH on the high temperature side becomes convex during edging. The variation in the length direction elongation of the slab S during edging of the slab S results in camber in the slab S after undergoing the edging process.

In this manner, in cases in which a temperature variation is present across the width direction of the slab S, camber occurs in the slab S and slab thickness variation occurs between the two lateral face portions LP of the slab S after undergoing the edging process when employing the edging method of Comparative Example 1. When the horizontal rolling mill 12 performs thickness rolling on a slab S having such slab thickness variation across the width direction, out of the two lateral face portions LP of the slab S, the lateral face portion LPH on the side with the thicker slab thickness undergoes greater length direction elongation than the lateral face portion LPL on the with the thinner slab thickness, further exacerbating the camber of the slab S.

Figure 10:
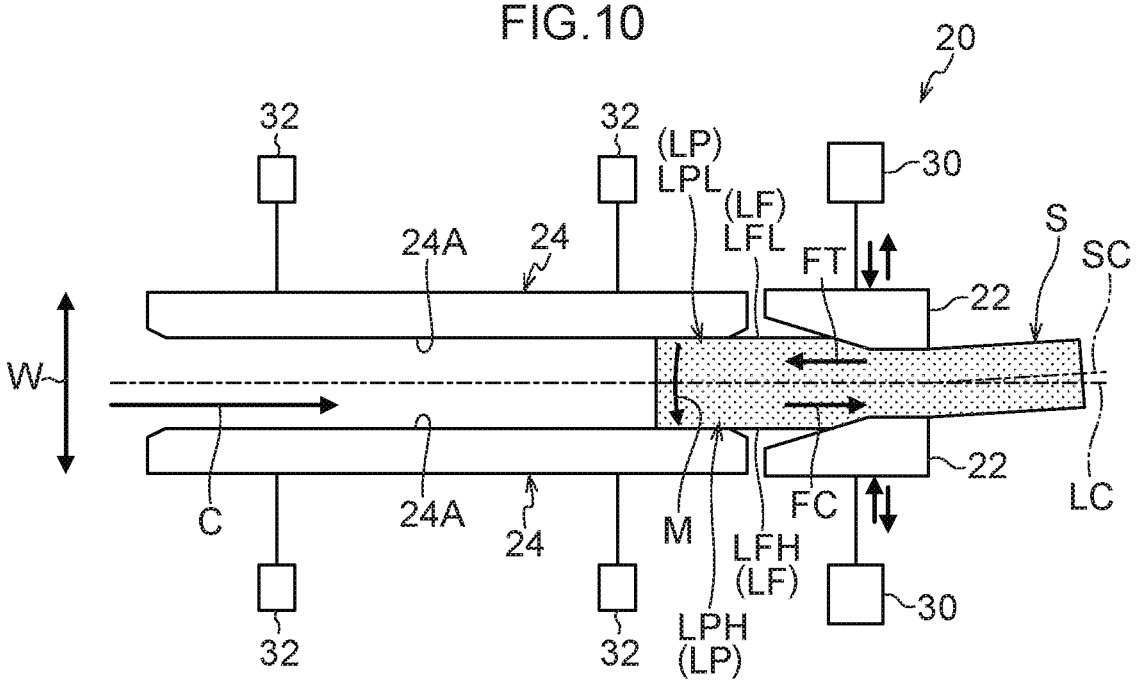
FIG. 10 is a plan view illustrating a state in which a slab is being edged using an edging method of Comparative Example 2.

In Comparative Example 2, corresponding to JP-U No. S62-96943, as illustrated in FIG. 10, the slab S undergoes edging while restrained in a state in which the position in the width direction of the slab center SC of the slab S is aligned with the position in the width direction of the conveyance line center LC using the pair of plate members 24. Although JP-U No. S62-96943 makes no reference to a mechanism for reducing camber, careful investigation by the inventors revealed the occurrence of the following phenomenon. In the edging method of Comparative Example 2, a moment M arises in a part of the slab S subject to edging accompanying restraint of the slab S with the position in the width direction of the slab center SC aligned with the position in the width direction of the conveyance line center LC. Out of the two lateral face portions LP of the slab S, the moment M causes a compressive force FC in the length direction of the slab S to act on the lateral face portion LPH on the high temperature side, and causes a tensile force FT in the length direction of the slab S to act on the lateral face portion LPL on the low temperature side. Accordingly, at the lateral face portion LP side on the high temperature side, deformation of the slab S due to edging occurs less readily than when unrestrained due to the compressive force acting in the length direction. On the other hand, at the lateral face portion LPL on the low temperature side, deformation occurs more readily than when unrestrained due to the tensile force acting in the length direction. As a result, out of the two lateral face portions LP of the slab S, the variation between the ease of deformation of the lateral face portion LPH on the high temperature side and the lateral face portion LPL on the low temperature side becomes small. Camber and slab thickness variation of the slab S are therefore also reduced in comparison to Comparative Example 1. However, the moment M imparted due to the restraint mentioned above is not based on information relating to the temperature variation across the width direction of the slab S that is a cause of camber and slab thickness variation, and so not only would camber and slab thickness variation not be eliminated, but in some cases excessive camber and slab thickness variation could occur.

By expanding on the investigation discussed above, the inventors arrived at the idea that were an appropriate moment to be applied based on information relating to the slab, both the lateral face portion LPH on the high temperature side and the lateral face portion LPL on the low temperature side could be made to deform with a similar degree of readiness, even if a temperature distribution were present across the width direction of the slab S.

In the present exemplary embodiment, the slab S is applied with an incident angle θ based on the acquired temperature information, such that that rear end of the lateral face LFL on the low temperature side of the slab S moves away from the conveyance line center LC. This thereby enables a more appropriate moment M to be applied than in cases in which the position in the width direction of the slab center SC of the slab S is restrained in alignment with the position in the width direction of the conveyance line center LC, as in Comparative Example 2. Accordingly, out of the two lateral face portions LP of the slab S, the compressive force FC acting on the lateral face portion LPH on the high temperature side and the tensile force FT acting on the lateral face portion LPL on the low temperature side can be adjusted appropriately. This thereby enables the lateral face portion LPH on the high temperature side and the lateral face portion LPL on the low temperature side of the slab S to deform with a similar degree of readiness. As a result, the width direction deformation amount, the slab thickness direction deformation amount, and the slab length direction deformation amount of the slab S can be made similar at the lateral face portion LPH on the high temperature side and at the lateral face portion LPL on the low temperature side, thereby enabling camber of the slab S, and asymmetry (namely slab thickness variation) in the cross-section profile in the width direction of the slab S, after the slab S has been through the edging process, to be suppressed. This thereby enables camber to be suppressed when the slab S is thickness rolled by the horizontal rolling mill 12. Note that in FIG. 12, the cross-section profile of a slab S subjected to edging according to the present exemplary embodiment is illustrated by dashed lines, and the cross-section profile of a slab S subjected to edging according to Comparative Example 1 is illustrated by double-dotted dashed lines.

Figure 6:
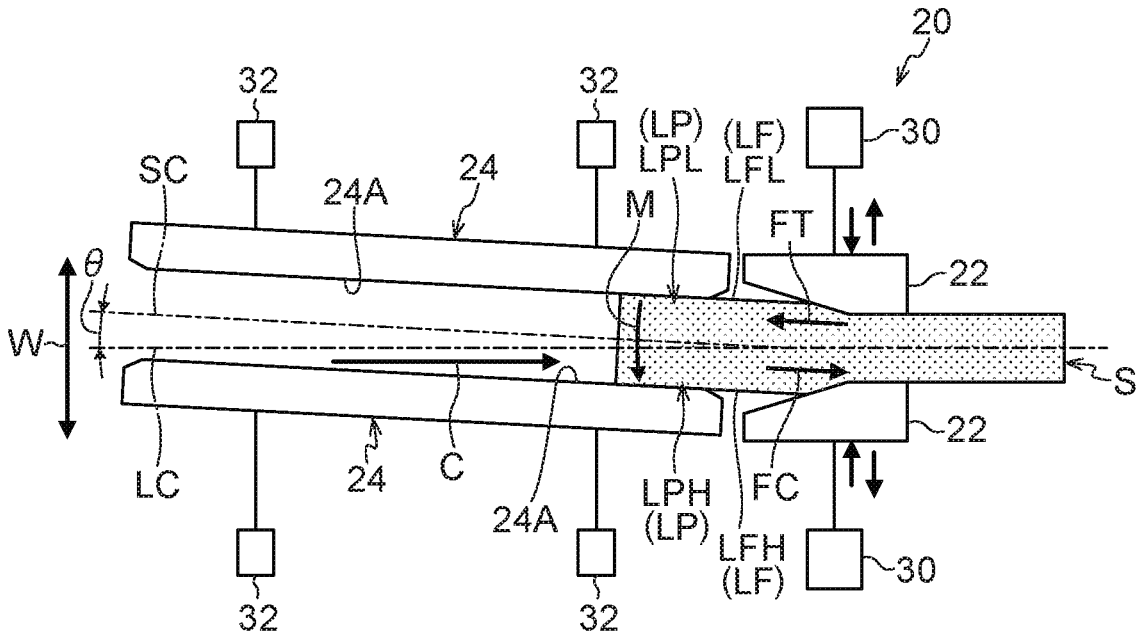
FIG. 6 is a plan view illustrating a state in which the trailing end side of the slab has moved even further in the width direction of the conveyance line than in the state illustrated in FIG. 5, thereby increasing the incident angle.

In particular, in the present exemplary embodiment, as illustrated in FIG. 4 to FIG. 6, the incident angle θ is changed according to the temperature variation across the width direction of the slab S, and the edging progress status of the slab S. Specifically, during edging of the leading end portion of the slab S, the incident angle θ is set to zero, or a value close to zero. The incident angle θ is made larger as the edging progress status of the slab S progresses. The incident angle θ is decreased as edging of the trailing end of the slab S approaches, and during edging of the trailing end portion of the slab S, the incident angle θ is changed to zero, or a value close to zero. Accordingly, the compressive force FC acting on the lateral face portion LPH on the high temperature side and the tensile force FT acting on the lateral face portion LPL on the low temperature side of the slab S can be adjusted even more appropriately.

In the first exemplary embodiment, configuration is made in which the incident angle θ is set based on the temperature distribution at the surface of the slab S; however, the present disclosure is not limited to such a configuration. For example, configuration may be made in which the temperature of a thickness direction central portion of the slab S is estimated based on thermal conductivity logic, using either estimated average temperatures of specific ranges in the width direction from the lateral faces LF of the slab S, or the surface temperature of the slab S. The temperature variation across the width direction of the slab S may then be computed, and the incident angle θ set based on this temperature variation. With such configuration, properties such as the readiness with which the slab S will deform during edging can be obtained with greater precision than in the first exemplary embodiment, thereby enabling camber of the slab S arising after the slab has been through the edging process, and slab thickness variation across the width direction, to be suppressed.

Note that in the first exemplary embodiment, configuration is made in which the incident angle θ is changed according to the edging progress status of the slab S; however, the present disclosure is not limited to such a configuration. For example, the incident angle θ may be fixed. This configuration may also be applied in the following exemplary embodiments.

Second Exemplary Embodiment

Next, explanation follows regarding an edging method and an edging device of a second exemplary embodiment. Note that configurations similar to those of the first exemplary embodiment are allocated the same reference numerals, and explanation thereof is omitted as appropriate.

Figure 13:
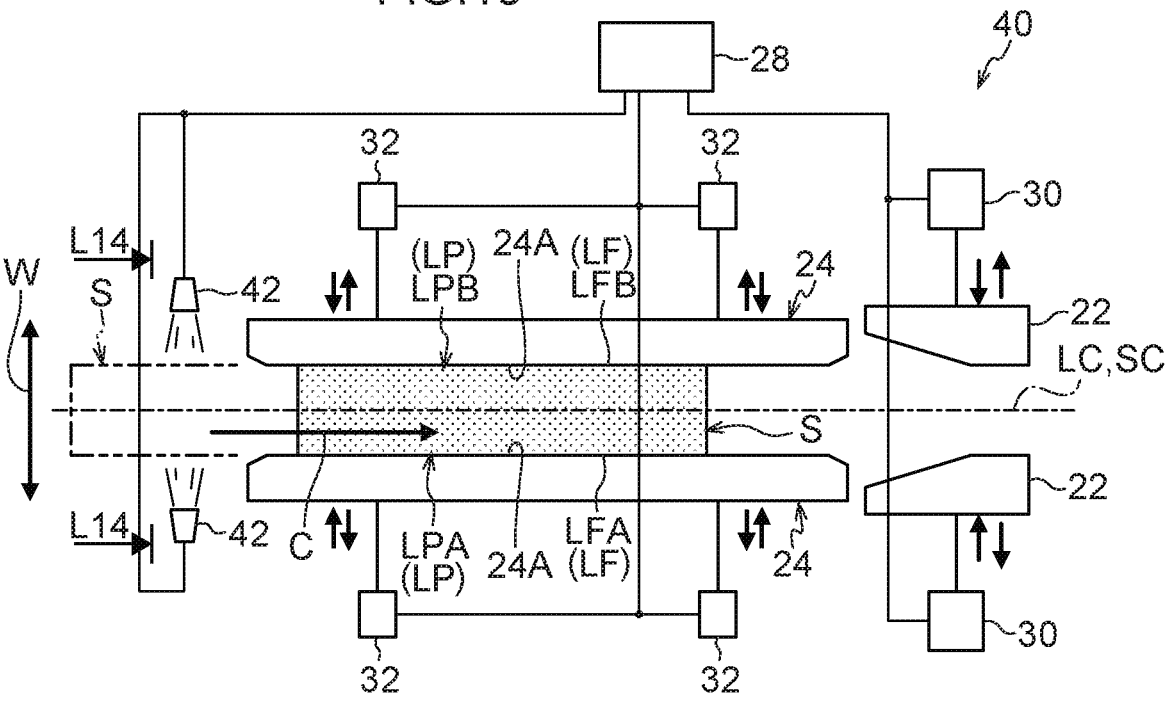
FIG. 13 is a plan view illustrating a state prior to edging of a slab in an edging device of a second exemplary embodiment.

As illustrated in FIG. 13, an edging device 40 of the present exemplary embodiment has a similar configuration to the edging device 20 of the first exemplary embodiment, with the exception of a configuration in which CCD cameras 42, serving as an example of a slab information acquisition means, are provided between the heating furnace 10 and the plate members 24.

The respective CCD cameras 42 are installed at the outer sides in the width direction of the conveyance line L, and are configured so as to image both lateral faces LF of the slab S from the respective sides. Images captured by the CCD cameras 42 are sent to the controller 28.

The controller 28 of the present exemplary embodiment computes a slab thickness variation between the two lateral faces LF of the slab S based on image information from the CCD cameras 42. Moreover, the controller 28 operates the moving mechanisms 32 to apply the slab S with an incident angle θ, such that a lateral face LFB on the side where the slab thickness is thicker moves away from the conveyance line center LC.

Next, explanation follows regarding the edging method of the present exemplary embodiment. Note that the edging method of the present exemplary embodiment employs the edging device 40.

The edging method of the present exemplary embodiment is similar to the edging method of the first exemplary embodiment, with the exception of the configuration in which the incident angle θ is set using the slab thickness variation between the two lateral faces LF of the slab S, instead of the temperature variation across the width direction of the slab S. Accordingly, the control routine of the incident angle θ of the slab S by the controller 28 is the same as that illustrated in FIG. 4 to FIG. 6.

In the edging process of the present exemplary embodiment, based on image information of the slab S acquired from the CCD camera 42, the controller 28 controls the moving mechanisms 32 to apply the slab S with the incident angle θ in cases in which there is a slab thickness variation between the two lateral faces LF of the slab S. Specifically, the slab S is sandwiched from both sides in the width direction by the pair of plate members 24, and in this state, the moving mechanisms 32 are controlled to move and tilt the plate members 24 such that the rear end of the lateral face LFB (the lateral face on the upper side in FIG. 4 to FIG. 6) on the side where the slab thickness of the slab S is thicker moves away from the conveyance line center LC, thus applying the slab S with the incident angle θ. Note that in the present exemplary embodiment, the incident angle θ is set according to the slab thickness variation between the two lateral faces LF of the slab S, and according to the edging progress status of the slab S. Specifically, during edging of the leading end portion of the slab S (see FIG. 4), hardly any camber deformation occurs, and so the incident angle θ is set to zero, or a value close to zero. As the edging progress status of the slab S (in other words, the position up to which edging has been performed along the length direction of the slab S) progresses, the incident angle θ is made larger (see FIG. 5 and FIG. 6). As edging of the trailing end of the slab S approaches, the incident angle θ is reduced (see FIG. 7), and during edging of the trailing end of the slab S, the incident angle θ is set to zero, or a value close to zero (see FIG. 8). Moreover, the amount by which the incident angle θ is increased is set so as to become greater the larger the slab thickness variation between the two lateral faces LF of the slab S. Note that the edging progress status of the slab S is computed based on position information of the slab S from the position sensors mentioned above.

The incident angle θ is preferably changed based on at least one piece of information out of the edging method of the slab S, the dimensions of the slab S, the edging amount of the slab S, or the type of steel of the slab S, in addition to the slab thickness variation between the two lateral faces LF of the slab S. Setting the incident angle θ based on such information relating to the slab S in addition to the slab thickness variation between the two lateral faces LF of the slab S enables a more appropriate incident angle θ to be obtained for the slab S.

Next, explanation follows regarding operation and advantageous effects of the second exemplary embodiment. Note that explanation regarding operation and advantageous effects obtained from configurations similar to those of the first exemplary embodiment is omitted. In the following explanation, explanation is given regarding a case in which a slab thickness variation is present between the two lateral faces LF of the slab S, as illustrated by imaginary lines (double-dotted dashed lines) in FIG. 17.

Figure 17:
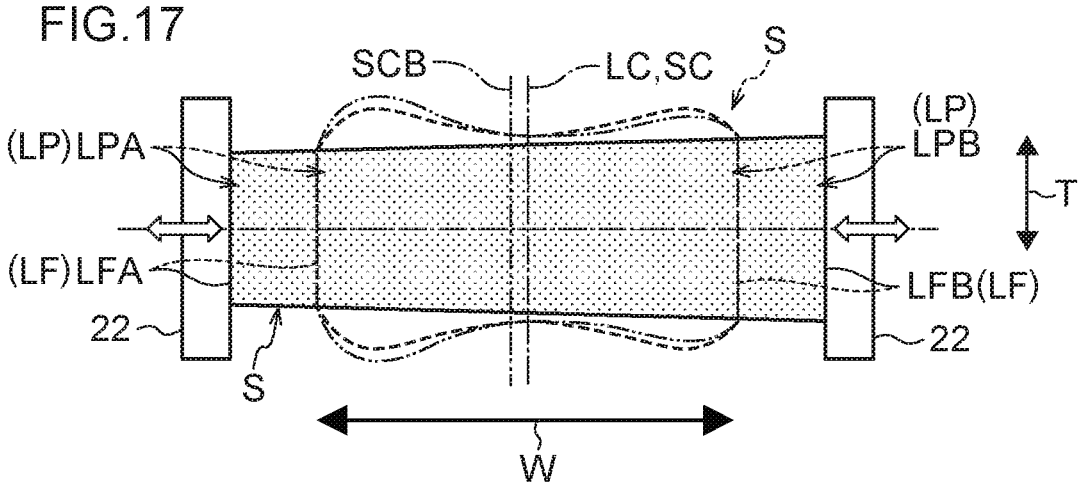
FIG. 17 is a schematic diagram (a schematic diagram corresponding to FIG. 12) illustrating a cross-section profile of a slab after edging.

In cases in which edging is performed in a state in which a slab thickness variation is present between the two lateral faces LF of the slab S, a lateral face portion LPA including a lateral face LFA on the side where the slab thickness is thinner (the lateral face on the left side in FIG. 17) deforms more readily than a lateral face portion LPB including a lateral face LFB on the side where the slab thickness is thicker (the lateral face on the right side in FIG. 17). Accordingly, deformation of the slab S in the slab thickness direction would be expected to be greater at the lateral face portion LPA on the side where the slab thickness is thinner than at the lateral face portion LPB on the side where the slab thickness is thicker (see the doubled-dotted dashed lines in FIG. 17). The slab thickness variation between the two lateral faces LF of the slab S would accordingly increase after edging. If the slab S were thickness rolled by the horizontal rolling mill 12 in this state, camber would occur to cause the lateral face LFA on the side where the slab thickness is thicker after edging (the side where the slab thickness is thinner prior to edging) to become convex.

By contrast, in the present exemplary embodiment, if a slab thickness variation is present between the two lateral faces LF of the slab S, the incident angle θ of the slab S can be set according to the slab thickness variation between the two lateral faces LF of the slab S. This thereby enables camber and slab thickness variation across the width direction of the slab S to be suppressed from arising after the slab S has been through the edging process (see the dashed lines in FIG. 17). Accordingly, camber is also suppressed when the slab S is thickness rolled by the horizontal rolling mill 12.

Figure 14:
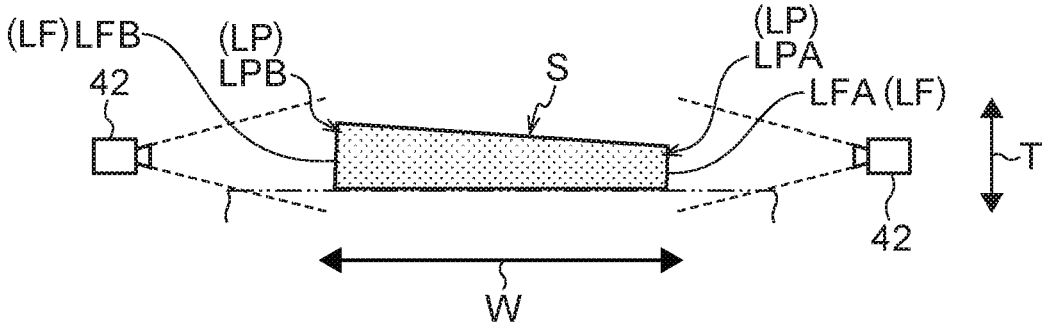
FIG. 14 is a cross-section taken along line L14-L14 of FIG. 13, and illustrates means employed to find a slab thickness variation across a slab width direction prior to edging.
Figure 15:
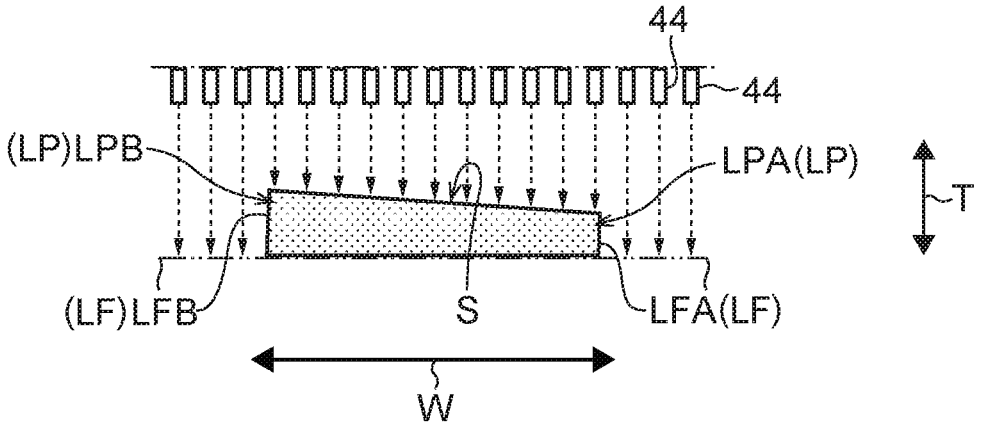
FIG. 15 illustrates a first modified example of an edging device of the second exemplary embodiment, and is a cross-section (a cross-section corresponding to FIG. 14) illustrating means employed to find a slab thickness variation across a slab width direction prior to edging.
Figure 16:
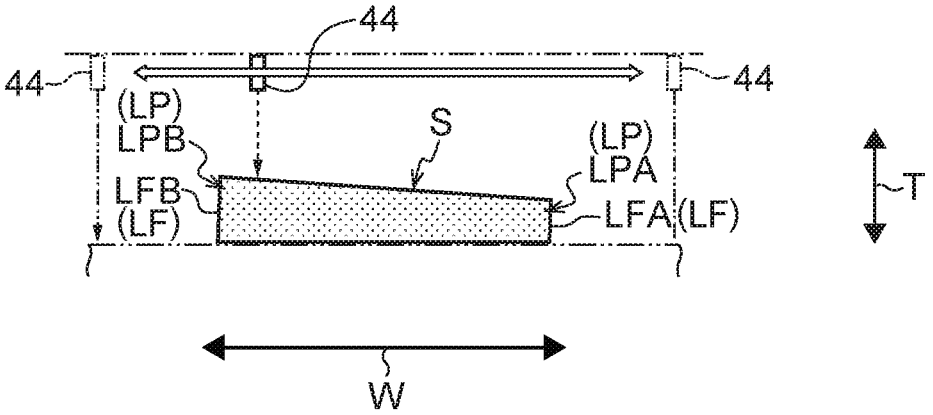
FIG. 16 illustrates a second modified example of an edging device of the second exemplary embodiment, and is a cross-section (a cross-section corresponding to FIG. 14) illustrating means employed to find a slab thickness variation across a slab width direction prior to edging.

In the second exemplary embodiment, as illustrated in FIG. 14, the slab thickness variation between the lateral faces on the two sides in the width direction of the slab S is computed based on the image information captured by the CCD cameras 42; however, the present disclosure is not limited to such a configuration. For example, as illustrated in FIG. 15, configuration may be made in which, instead of the CCD cameras 42, plural distance sensors 44 are installed at intervals in the width direction above the conveyance line L, the distance to the upper face of the conveyed slab S is measured, and the slab thickness variation across the width direction of the slab S is computed based on the measured information. Moreover, as illustrated in FIG. 16, configuration may be made in which a moving device, not illustrated in the drawings, is employed to move a single distance sensor 44 in the width direction of the conveyance line L so as to measure the distance to the upper face of the slab S, and the slab thickness variation across the width direction of the slab S is computed based on the measured information.

Third Exemplary Embodiment

Next, explanation follows regarding an edging method and an edging device of a third exemplary embodiment. Note that configurations similar to those of the first exemplary embodiment are allocated the same reference numerals, and explanation thereof is omitted as appropriate.

Figure 18:
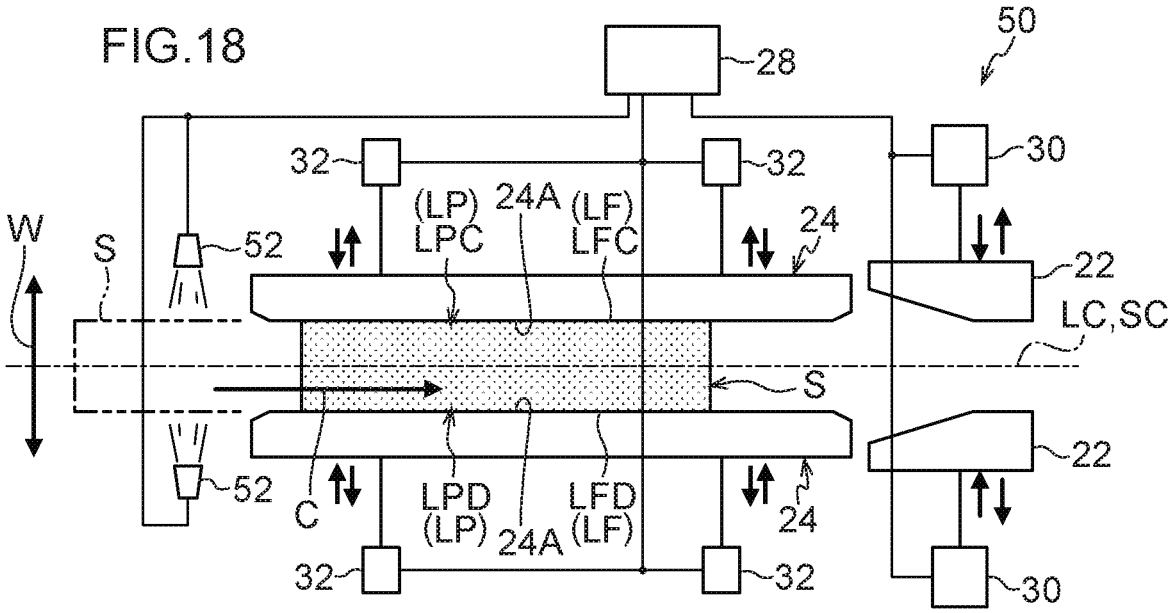
FIG. 18 is a plan view illustrating a state prior to edging of a slab in an edging device of a third exemplary embodiment.

As illustrated in FIG. 18, an edging device 50 of the present exemplary embodiment has a similar configuration to the edging device 20 of the first exemplary embodiment, with the exception of a configuration in which CCD cameras 52, serving as an example of a slab information acquisition means, are provided between the heating furnace 10 and the plate members 24.

The respective CCD cameras 52 are installed at the outer sides in the width direction of the conveyance line L, and are configured so as to image both lateral faces LF of the slab S from the respective sides. Images captured by the CCD cameras 52 are sent to the controller 28.

The controller 28 of the present exemplary embodiment computes variation between the coefficients of friction at both lateral faces LF of the slab S based on image information from the CCD cameras 52. For example, the variation in the coefficient of friction can be computed from differences between the states of adhered material in the image information, or differences in the brightness distribution in the image information. For example, of the two lateral face portions LF, the lateral face LF on the side where there is a greater amount of adhered material (scale) has a lower coefficient of friction with respect to the edging member 22 than the lateral face LF on the side where there is a smaller amount of adhered material. Accordingly, the variation between the coefficients of friction can be computed based on the difference between the amounts of adhered material at both lateral faces LF. Moreover, for example, out of the two lateral faces LF, the lateral face LF on the side with higher brightness has a lower coefficient of friction than the lateral face LF on the side with lower brightness, and so the variation between the coefficients of friction can be computed based on the difference in brightness between the two lateral faces LF. Moreover, the controller 28 operates the moving mechanisms 32 so as to apply the slab S with an incident angle θ such that the lateral face LFC (the lateral face on the upper side in FIG. 18) on the side with a higher coefficient of friction moves away from the conveyance line center LC.

Next, explanation follows regarding the edging method of the present exemplary embodiment. Note that the edging method of the present exemplary embodiment employs the edging device 50.

The edging method of the present exemplary embodiment is similar to the edging method of the first exemplary embodiment, with the exception of a configuration in which the incident angle θ is set using the variation between the coefficients of friction at both lateral faces LF of the slab S, instead of the temperature distribution across the width direction of the slab S. Accordingly, the control routine for the incident angle θ of the slab S by the controller 28 is the same as that illustrated in FIG. 4 to FIG. 6.

In the edging process of the present exemplary embodiment, based on image information of the slab S acquired from the CCD cameras 52, the controller 28 controls the moving mechanisms 32 to apply the slab S with the incident angle θ in cases in which a variation is present between the coefficients of friction at both lateral faces LF of the slab S. Specifically, the slab S is sandwiched from both sides in the width direction by the pair of plate members 24, and in this state, the moving mechanisms 32 are controlled to move and tilt the plate members 24 such that the rear end of the lateral face LFC (the lateral face on the upper side in FIG. 4 to FIG. 6) on the side where the coefficient of friction of the slab S is greater moves away from the conveyance line center LC, thus applying the slab S with the incident angle θ. Note that in the present exemplary embodiment, the incident angle θ is set according to the variation between the coefficients of friction at both lateral faces LF of the slab S, and according to the edging progress status of the slab S. Specifically, during edging of the leading end portion of the slab S (see FIG. 4), hardly any camber deformation occurs, and so the incident angle θ is set to zero, or a value close to zero. As the edging progress status of the slab S (in other words, the position up to which edging has been performed along the length direction of the slab S) progresses, the incident angle θ is made larger (see FIG. 5 and FIG. 6). As edging of the trailing end of the slab S approaches, the incident angle θ is reduced (see FIG. 7), and during edging of the trailing end of the slab S, the incident angle θ is set to zero, or a value close to zero (see FIG. 8). Moreover, the amount by which the incident angle θ is increased is set so as to become greater the larger the variation between the coefficients of friction at both lateral faces LF of the slab S. Note that the edging progress status of the slab S is computed based on position information of the slab S from the position sensors mentioned above.

The incident angle θ is preferably changed based on at least one piece of information out of the edging method of the slab S, the dimensions of the slab S, the edging amount of the slab S, or the type of steel of the slab S, in addition to the variation between the coefficients of friction at both lateral faces LF of the slab S. Setting the incident angle θ based on such information relating to the slab S in addition to the variation between the coefficients of friction at both lateral faces LF of the slab S enables a more appropriate incident angle θ to be obtained for the slab S.

Next, explanation follows regarding operation and advantageous effects of the present exemplary embodiment. Note that explanation regarding operation and advantageous effects obtained from configurations similar to those of the first exemplary embodiment is omitted. In the following explanation, explanation is given regarding a case in which a variation is present between the coefficients of friction at both lateral faces LF of the slab S, as illustrated by imaginary lines (double-dotted dashed lines) in FIG. 19.

Figure 19:
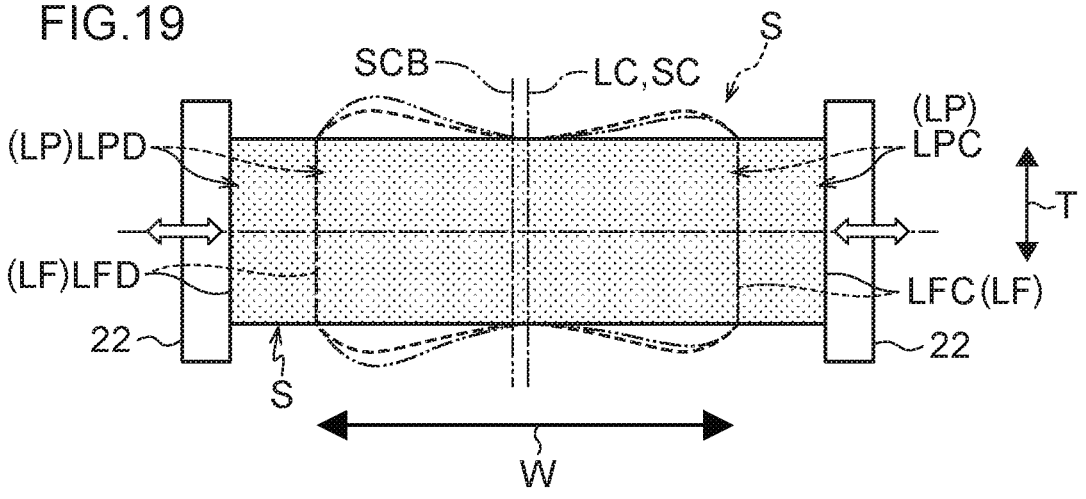
FIG. 19 is a schematic diagram (a schematic diagram corresponding to FIG. 12) illustrating a cross-section profile of a slab after edging.

In cases in which edging is performed in a state in which a variation is present between the coefficients of friction at both lateral faces LF of the slab S, a lateral face portion LPC including a lateral face LFC (the lateral face on the right side in FIG. 19) on the side where the coefficient of friction is higher deforms less readily than a lateral face portion LPD including a lateral face LFD (the lateral face on the left side in FIG. 19) on the side where the coefficient of friction is lower. Accordingly, as illustrated in FIG. 19, deformation of the slab S in the slab thickness direction would be expected to be greater at the lateral face portion LPD on the side where the coefficient of friction is lower than at the lateral face portion LPC on the side where the coefficient of friction is higher (see the doubled-dotted dashed lines in FIG. 19). The slab thickness variation between the two lateral faces LF of the slab S after edging would accordingly increase. If the slab S were thickness rolled by the horizontal rolling mill 12 in this state, camber would occur to cause the lateral face LFD on the side where the slab thickness is thicker after edging (the side where the coefficient of friction is lower) to become convex.

By contrast, in the present exemplary embodiment, even if a variation is present between the coefficients of friction at both lateral faces LF of the slab S, the incident angle θ of the slab S can be set according to the variation between the coefficients of friction at both lateral faces LF of the slab S. This thereby enables camber and slab thickness variation across the width direction of the slab S to be suppressed from arising after the slab S has been through the edging process (see the dashed lines in FIG. 19). Accordingly, camber is also suppressed when the slab S is thickness rolled by the horizontal rolling mill 12.

In the third exemplary embodiment, the variation between the coefficients of friction at both lateral faces LF of the slab S is computed based on information captured by the CCD cameras 52; however, the present disclosure is not limited to such a configuration. For example, configuration may be made in which the slab thickness variation between the two lateral faces LF of the slab S is also computed from information captured by the CCD cameras 52, and the incident angle θ of the slab S is determined based on the slab thickness variation and the variation between the coefficients of friction. In such cases, CCD cameras may be employed for both purposes, enabling a reduction in the number of components configuring the device.

Fourth Exemplary Embodiment

Next, explanation follows regarding an edging method and an edging device of a fourth exemplary embodiment. Note that configurations similar to those of the first exemplary embodiment are allocated the same reference numerals, and explanation thereof is omitted as appropriate.

Edging Device

Figure 20:
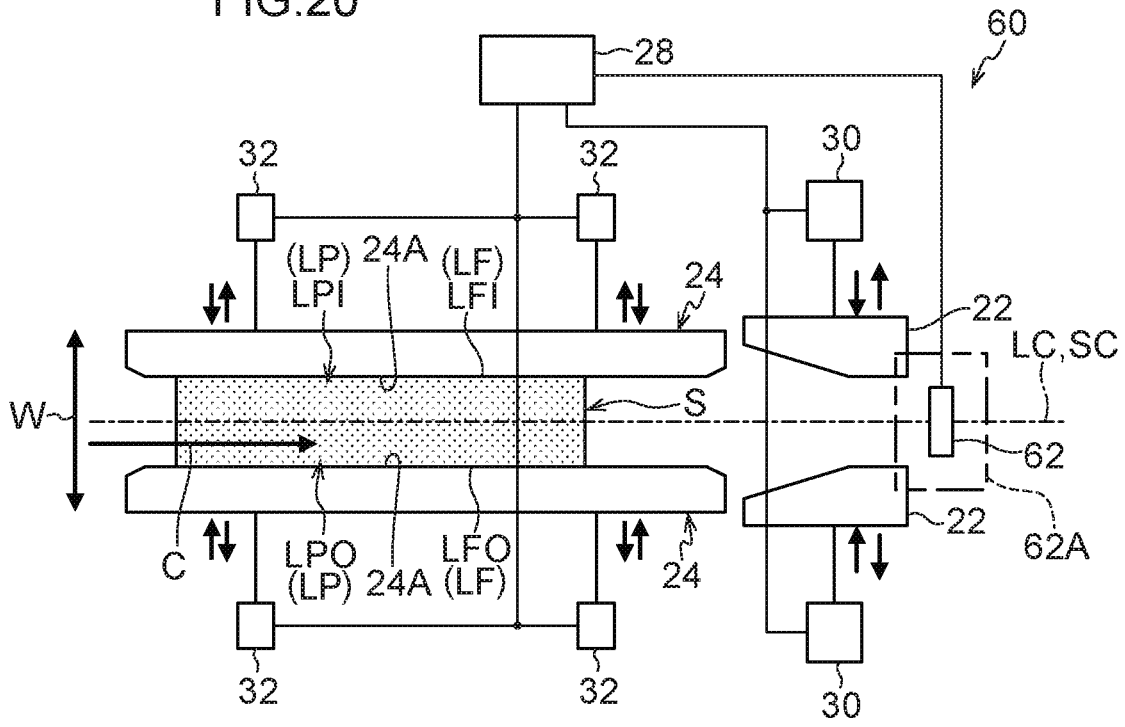
FIG. 20 is a plan view schematically illustrating an edging device of a fourth exemplary embodiment.

As illustrated in FIG. 20, an edging device 60 of the present exemplary embodiment has a similar configuration to the edging device 20 of the first exemplary embodiment, with the exception of a configuration in which a CCD camera 62, serving as an example of a slab information acquisition means, is provided at an edging output side of the slab S, and the incident angle θ of the slab S is determined according to the camber at the edging output side of the slab S.

The CCD camera 62 is installed over the slab S at the edging output side of the edging device 60 (in other words, downstream of the pair of edging members 22), and is configured so as to image the part of the slab S that has been subjected to edging, from above. An imaging region of the CCD camera 62 is set as the region illustrated by double-dotted dashed lines in FIG. 20 to FIG. 26. Images captured by the CCD camera 62 are sent to the controller 28. Note that the controller 28 and the CCD camera 62 are omitted from illustration in FIG. 21 to FIG. 26.

The controller 28 of the present exemplary embodiment computes a camber amount of the part of the slab S that has been subjected to edging based on image information sent from the CCD camera 62. For example, the camber amount of the part of the slab S that has been subjected to edging can be computed from displacement in the width direction of the conveyance line L at points on the lateral faces LF of the slab S accompanying the progress of edging. According to the computed camber amount, the controller 28 changes the incident angle θ of the slab S such that during edging, out of the two lateral faces LF of the slab S, a rear end of a lateral face LFI that is on a peripheral inside of the curve moves away from the conveyance line center LC.

Note that in addition to the image information of the part of the slab S that has been subjected to edging, similarly to in the first exemplary embodiment, the controller 28 is also sent information such as the slab edging method, the dimensions of the slab S, an edging amount of the slab S, and the type of steel of the slab S. The controller 28 may determine the incident angle θ based on at least one piece of information out of the slab edging method, the dimensions of the slab S, the edging amount of the slab S, and the type of steel of the slab S, in addition to the image information of the part of the slab S that has been subjected to edging.

Edging Method

Next, explanation follows regarding the edging method of the fourth exemplary embodiment. Note that the edging method of the present exemplary embodiment employs the edging device 60. Moreover, in the following explanation, explanation is given regarding a case in which camber occurs at the edging output side of the slab S.

Figure 21:
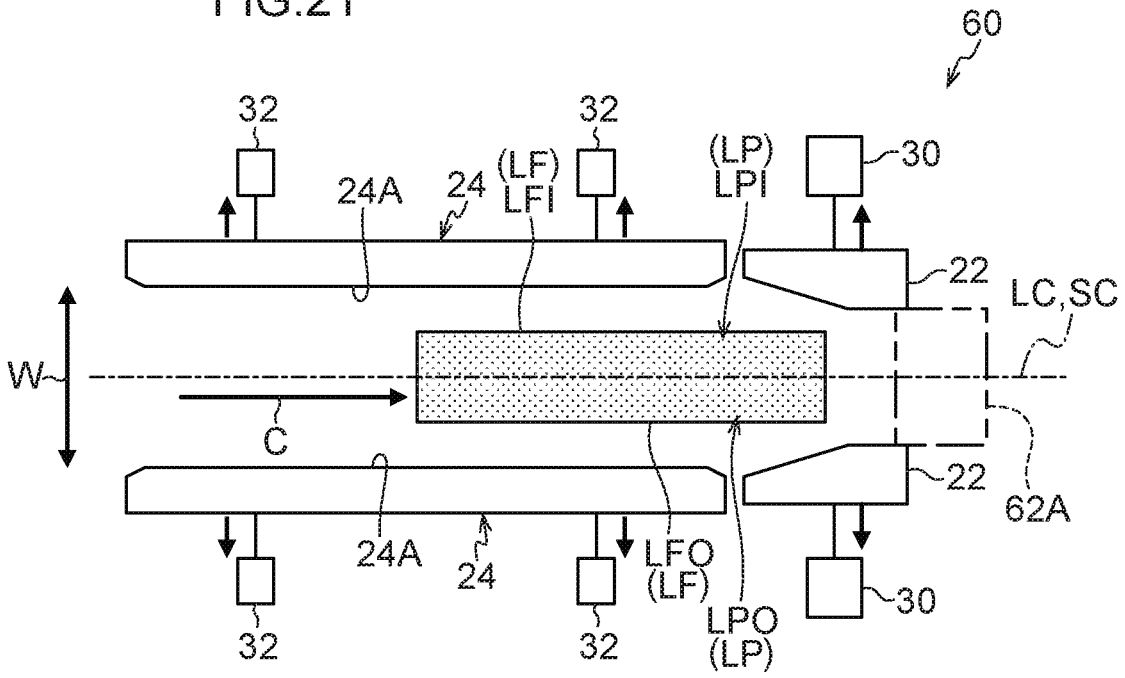
FIG. 21 is a plan view illustrating a state prior to edging of a slab in an edging device of the fourth exemplary embodiment.
Figure 22:
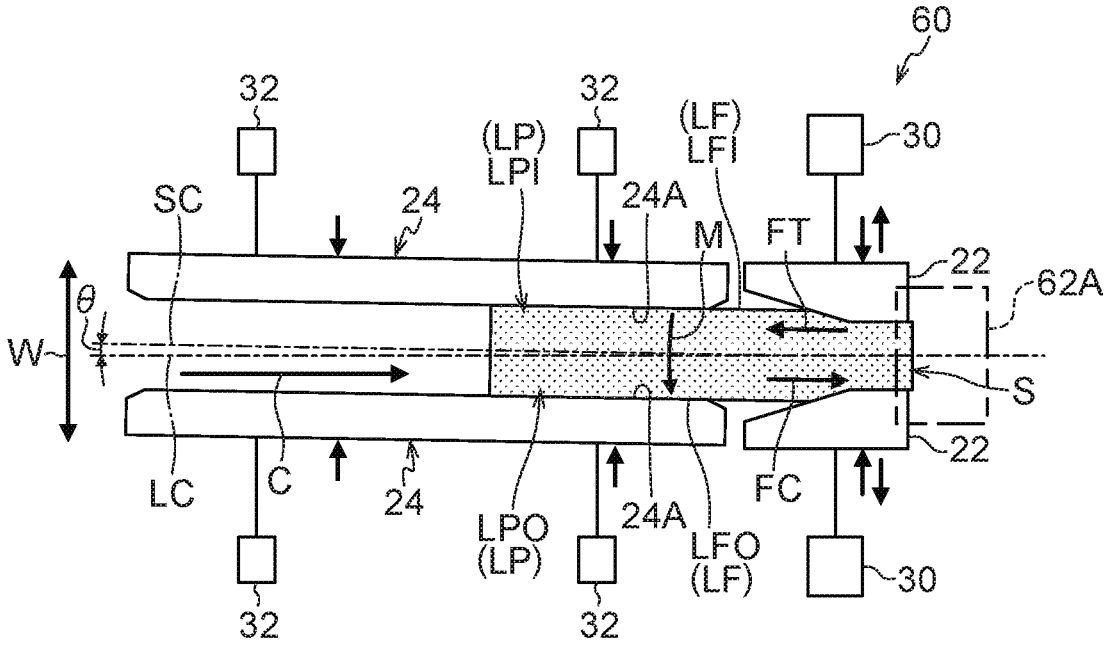
FIG. 22 is a plan view illustrating a state following on from FIG. 21, in which a trailing end side of the slab sandwiched between a pair of plate members is moved in a width direction of the conveyance line to apply an incident angle to the slab, while edging a leading end side of the slab.

First, as illustrated in FIG. 20, a heated slab S is sandwiched from both sides by the pair of plate members 24, and the position in the width direction of the slab center SC is aligned with the position in the width direction of the conveyance line center LC (what is referred to as centering). Then, as illustrated in FIG. 21, the pair of plate members 24 are moved toward the outer sides in the width direction of the conveyance line L (sides away from the conveyance line center LC) such that the pair of plate members 24 separate from the slab S.

Next, as illustrated in FIG. 22, the slab S is again sandwiched in the width direction from both sides by the pair of plate members 24, and in this state, the slab S is applied with an incident angle θ such that the rear end of the lateral face LFI (the lateral face on the upper side in FIG. 23 to FIG. 25) that is on the peripheral inside of the curve of the slab S moves away from the conveyance line center LC. Note that until a specific amount of the leading end portion of the slab S has entered an imaging region 62A, for example, the incident angle θ is determined based on one or plural pieces of information out of preset information, slab S temperature information, slab thickness variation, or the variation between the coefficients of friction, and after the specific amount of the leading end portion of the slab S has entered the imaging region 62A, the incident angle θ is computed based on the camber amount (described in detail later).

Figure 23:
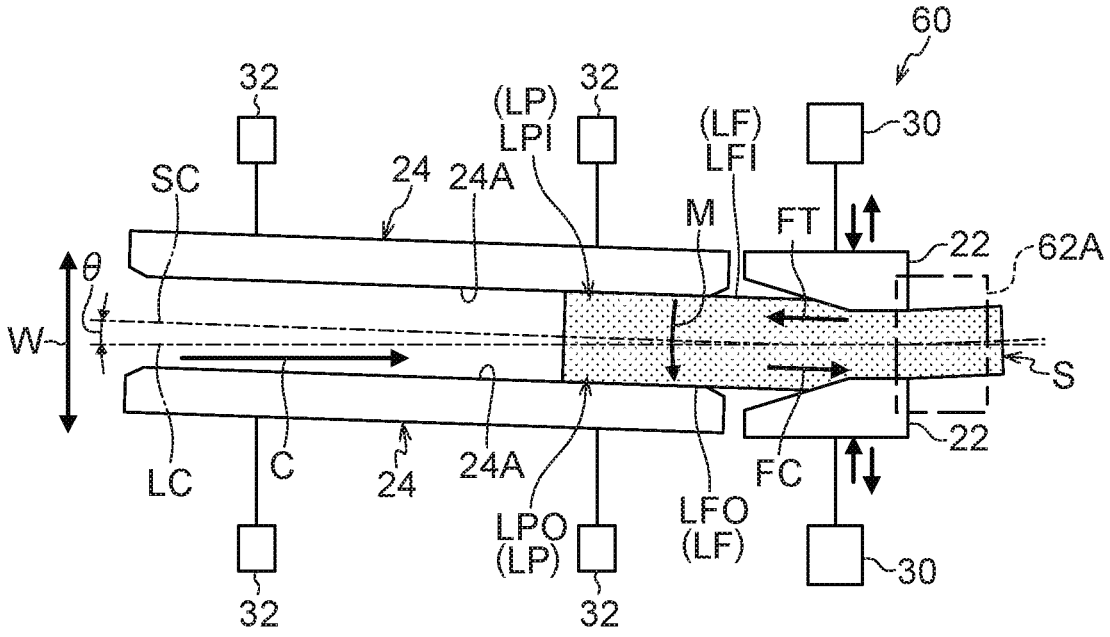
FIG. 23 is a plan view illustrating a state in which the trailing end side of the slab has moved further in the width direction of the conveyance line than in the state illustrated in FIG. 22, thereby increasing the incident angle.
Figure 24:
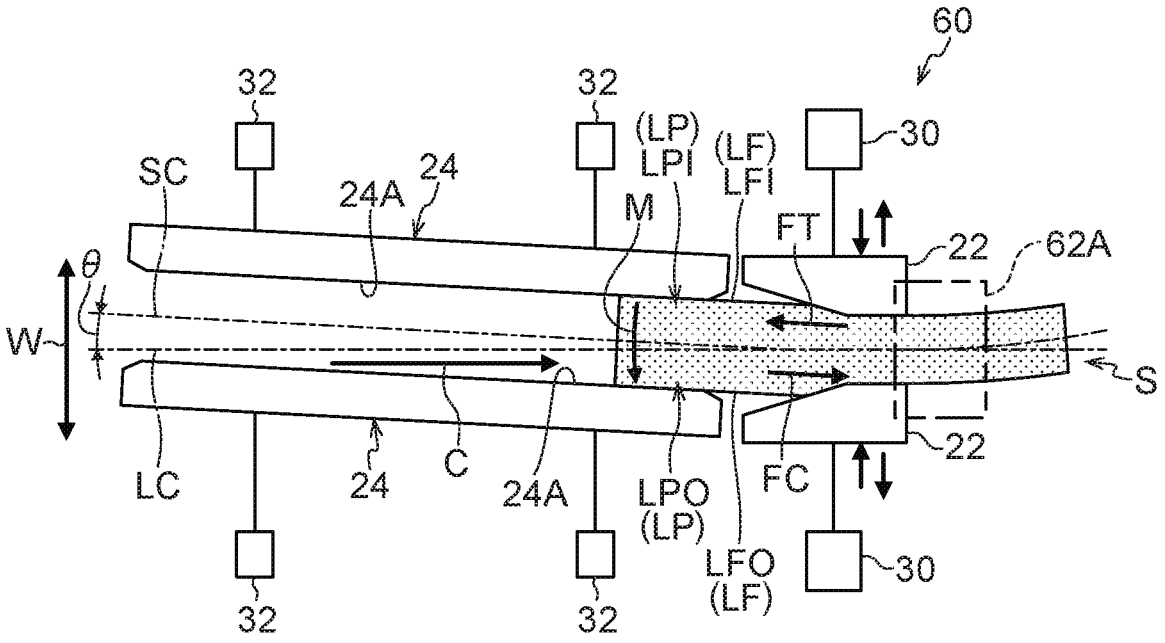
FIG. 24 is a plan view illustrating a state in which the trailing end side of the slab has moved even further in the width direction of the conveyance line than in the state illustrated in FIG. 23, thereby increasing the incident angle.

Next, as illustrated in FIG. 23, after the part of the slab S that has been subjected to edging has entered the imaging region 62A, the controller 28 computes the camber amount of the part of the slab S that has been subjected to edging based on the image information. The controller 28 then changes the incident angle θ of the slab S according to the computed camber amount and the edging progress status, such that the rear end of the lateral face LFI on the peripheral inside of the curve of the slab S during edging moves away from the conveyance line center LC. Note that in the present exemplary embodiment, the incident angle θ is gradually increased accompanying the progress of edging of the slab S, as illustrated in FIG. 24.

Figure 25:
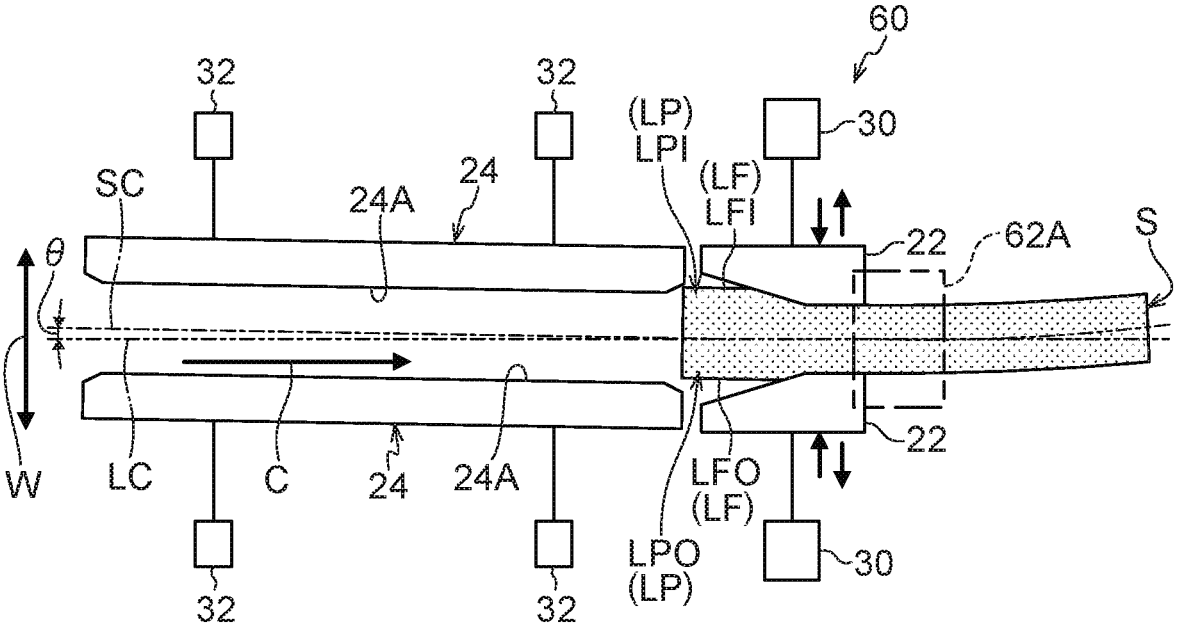
FIG. 25 is a plan view illustrating a state in which the trailing end side of the slab is being edged.

Next, as illustrated in FIG. 25, the controller 28 decreases the incident angle θ as edging of the trailing end of the slab S approaches. Then, during edging of the trailing end of the slab S, the incident angle θ is set to zero, or a value close to zero.

The incident angle θ is preferably changed based on at least one piece of information out of the edging method of the slab S, the dimensions of the slab S, the edging amount of the slab S, or the type of steel of the slab S, in addition to the image information of the part of the slab S that has been subjected to edging. Setting the incident angle θ based on such information relating to the slab S in addition to the image information of the part of the slab S that has been subjected to edging enables a more appropriate incident angle θ to be obtained for the slab S.

Figure 26:
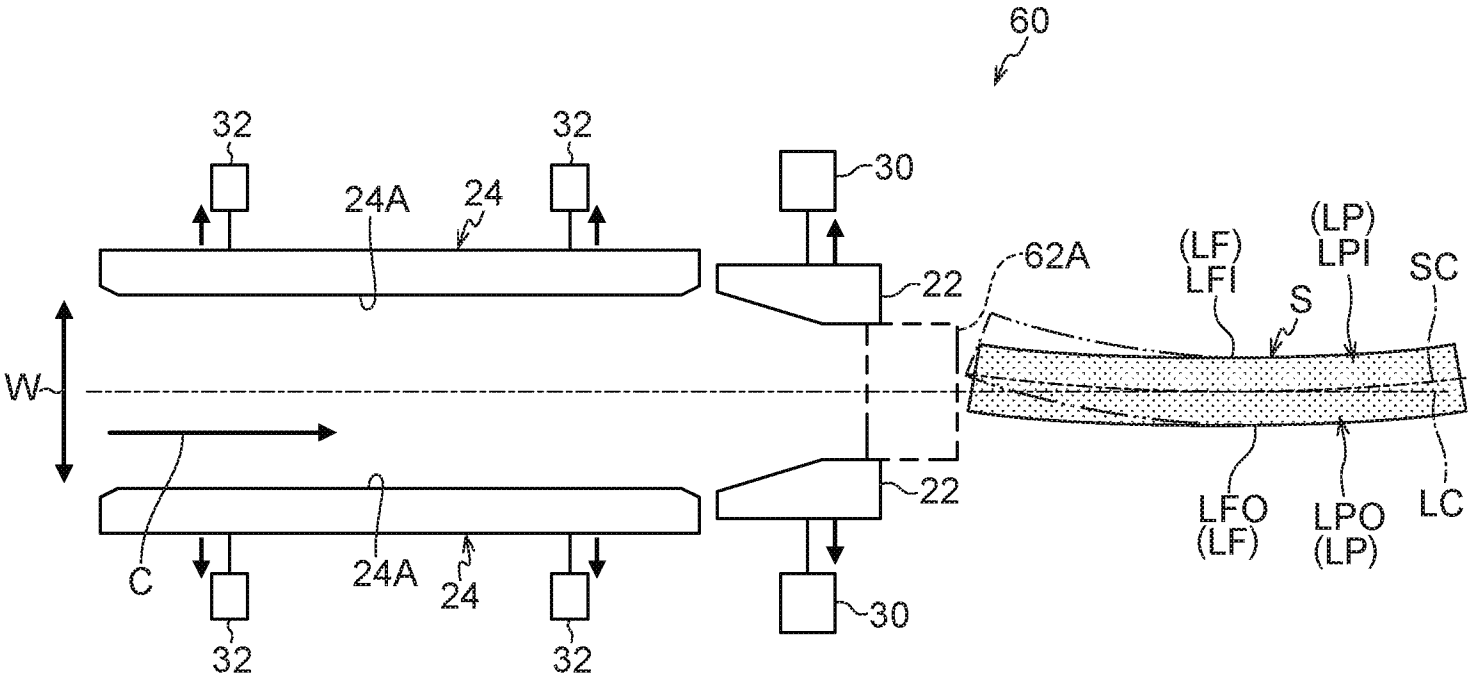
FIG. 26 is a plan view illustrating a state in which the edged slab has moved downstream of an edging member along the conveyance line.

After the slab S has moved downstream of the pair of plate members 24 along the conveyance line L, as illustrated in FIG. 26, the controller 28 operates the moving mechanisms 32 to return the positions in the width direction of the plate members 24 to their original positions, and to return the tilt of the plate members 24 with respect to the conveyance line center LC to the original tilt. Then, as illustrated in FIG. 26, the pair of plate members 24 adopt a standby state in a state at a separation from the conveyance line L in the width direction.

Next, explanation follows regarding operation and advantageous effects of the fourth exemplary embodiment. Note that explanation regarding operation and advantageous effects obtained from configurations similar to those of the first exemplary embodiment is omitted.

Camber occurs since even if the edging amount is the same on both sides of the slab S, the readiness with which the two lateral face portions LP deform differs. Namely, during edging of the slab S, the slab thickness increases more, and length direction elongation is greater, at the lateral face portion LP on the side that deforms more readily than at the lateral face portion LP on the side that deforms less readily, and so camber and width direction slab thickness variation occur in the slab S.

In the present exemplary embodiment, the slab S is applied with an incident angle θ according to the camber amount of the part of the slab S that has been subjected to edging, such that the rear end of the lateral face LFI (the lateral face LF on the upper side in FIG. 21 to FIG. 26) on the peripheral inside of the curve of the slab S moves away from the conveyance line center LC. Accordingly, out of the two lateral face portions LP of the slab S, the compressive force FC acting on a lateral face portion LPO, including a lateral face LFO, on the peripheral outside of the curve (the lateral face on the lower side in FIG. 21 to FIG. 26), and the tensile force FT acting on a lateral face portion LPI, including a lateral face LFI, on the peripheral inside of the curve can be adjusted more appropriately than in a configuration in which the slab S is not applied with an incident angle θ according to the camber amount of the part of the slab S that has been subjected to edging. This thereby enables the ease of deformation of the lateral face portion LPO on the peripheral outside of the curve and of the lateral face portion LPI on the peripheral inside of the curve of the slab S to be adjusted, such that they can be made to deform with the same degree of ease. This thereby enables camber of the slab S, and asymmetry (namely, slab thickness variation) in the width direction cross-section profile of the slab S, after having been through the edging process to be suppressed.

In the fourth exemplary embodiment, the incident angle θ is determined based on information other than the camber amount at an initial stage of edging only; however, the present disclosure is not limited to such a configuration. For example, the incident angle θ may be determined based on both the camber amount and information other than the camber amount of the part of the slab S that has been subjected to edging from the initial stage through to the final stage of edging. Note that examples of information other than the camber amount include one or plural pieces of information out of the temperature distribution of the slab S of the first exemplary embodiment, the slab thickness variation of the slab S of the second exemplary embodiment, and the variation between the coefficients of friction of the slab S of the third exemplary embodiment. In such cases, an even more appropriate incident angle θ of the slab S can be obtained.

Fifth Exemplary Embodiment

Next, explanation follows regarding an edging method and an edging device of a fifth exemplary embodiment. Note that configurations similar to those of the fourth exemplary embodiment are allocated the same reference numerals, and explanation thereof is omitted as appropriate.

Edging Device

Figure 27:
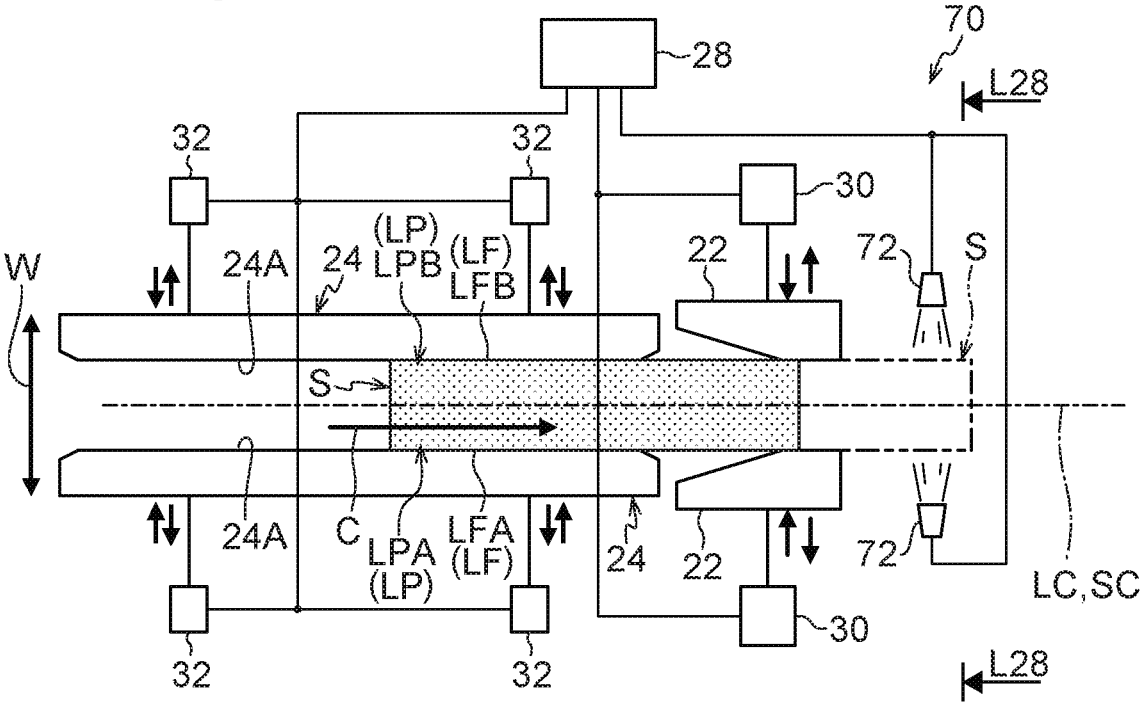
FIG. 27 is a plan view schematically illustrating an edging device of a fifth exemplary embodiment.

As illustrated in FIG. 27, an edging device 70 of the present exemplary embodiment has a similar configuration to the edging device 60 of the fourth exemplary embodiment, with the exception of a configuration in which CCD cameras 72, serving as an example of a slab information acquisition means, are provided at an edging output side of the slab S, and a configuration in which the incident angle θ of the slab S is determined according to the slab thickness variation between the two lateral face portions LP on the edging output side of the slab S.

The respective CCD cameras 72 are installed on both outer sides in the width direction of the conveyance line L on the slab S edging output side of the edging device 70 (in other words, downstream of the pair of edging members 22), and are configured to image both lateral face portions LP of the part of the slab S that has been subjected to edging from the respective sides. Images captured by the CCD cameras 72 are sent to the controller 28.

The controller 28 of the present exemplary embodiment computes a slab thickness variation from a maximum slab thickness portions of the two lateral face portions LP at the part of the slab S that has been subjected to edging, based on image information from the CCD cameras 72. The controller 28 operates the moving mechanisms 32 so as to apply the slab S with an incident angle θ, such that a rear end of a lateral face LFB on the side where the slab thickness is thinner (the side that deforms less readily prior to edging) out of the two lateral face portions LP of the part of the slab S that has been subjected to edging moves away from the conveyance line center LC.

Next, explanation follows regarding the edging method of the present exemplary embodiment. Note that the edging method of the present exemplary embodiment employs the edging device 70.

The edging method of the present exemplary embodiment is similar to the edging method of the fourth exemplary embodiment, with the exception of a configuration in which the incident angle θ is set using a slab thickness variation between the two lateral face portions LP of the slab S instead of the camber amount at the edging output side of the slab S. Accordingly, the control routine for the incident angle θ of the slab S by the controller 28 is the same as that illustrated in FIG. 21 to FIG. 26.

In the edging process of the present exemplary embodiment, the controller 28 computes the slab thickness variation between the two lateral face portions LP of the part of the slab S that has been subjected to edging based on the image information of the slab S acquired from the CCD cameras 72. The controller 28 then changes the incident angle θ of the slab S according to the computed slab thickness variation and the edging progress status, such that the rear end of the lateral face LFB on the side where the slab thickness of the slab S after edging is thinner moves away from the conveyance line center LC. Note that in the present exemplary embodiment, the incident angle θ is gradually increased accompanying the progress of edging of the slab S, as illustrated in FIG. 24.

Next, as illustrated in FIG. 25, the controller 28 decreases the incident angle θ as edging of the trailing end of the slab S approaches. Then, during edging of the trailing end of the slab S, the incident angle θ is set to zero, or a value close to zero.

The incident angle θ is preferably changed based on at least one piece of information out of the edging method of the slab S, the dimensions of the slab S, the edging amount of the slab S, or the type of steel of the slab S, in addition to the slab thickness variation between the two lateral face portions LP of the part of the slab S that has been subjected to edging. Setting the incident angle θ based on such information relating to the slab S in addition to the slab thickness variation between the two lateral face portions LP of the part of the slab S that has been subjected to edging enables a more appropriate incident angle θ to be obtained for the slab S.

After the slab S has moved downstream of the pair of plate members 24 along the conveyance line L, as illustrated in FIG. 26, the controller 28 operates the moving mechanisms 32 to return the positions in the width direction of the plate members 24 to their original positions, and to return the tilt of the plate members 24 with respect to the conveyance line center LC to the original tilt. Then, as illustrated in FIG. 26, the pair of plate members 24 adopt a standby state in a state at a separation from the conveyance line L in the width direction.

Next, explanation follows regarding operation and advantageous effects of the fifth exemplary embodiment. Note that explanation regarding operation and advantageous effects obtained from configurations similar to those of the fourth exemplary embodiment is omitted.

In the present exemplary embodiment, the slab S is applied with an incident angle θ according to the slab thickness variation between the two lateral face portions LP of the part of the slab S that has been subjected to edging, such that the rear end of the lateral face LFB (the lateral face on the upper side in FIG. 27, and the lateral face on the right side in FIG. 28), on the side where the slab thickness of the slab S is thinner after edging of the slab S, moves away from the conveyance line center LC. Accordingly, out of the two lateral face portions LP of the slab S, the compressive force FC acting on the lateral face portion LPA, including the lateral face LFA, on the side where the slab thickness after edging is thicker (the lateral face on the lower side in FIG. 27, and the lateral face on the left side in FIG. 28), and the tensile force FT acting on the lateral face portion LPB, including a lateral face LFB, on the side where the slab thickness after edging is thinner, can be adjusted more appropriately than in a configuration in which the slab S is not applied with an incident angle θ according to the slab thickness variation between the two lateral face portions LP at the part of the slab S that has been subjected to edging. This thereby enables the ease of deformation of the lateral face portion LPA on the side where the slab thickness is thicker, and the lateral face portion LPB on the side where the slab thickness is thinner after edging of the slab S, to be adjusted, such that they can be made to deform with the same degree of ease. This thereby enables camber of the slab S and asymmetry (namely, slab thickness variation) in the width direction cross-section profile of the slab S after having been through the edging process to be suppressed.

Figure 28:
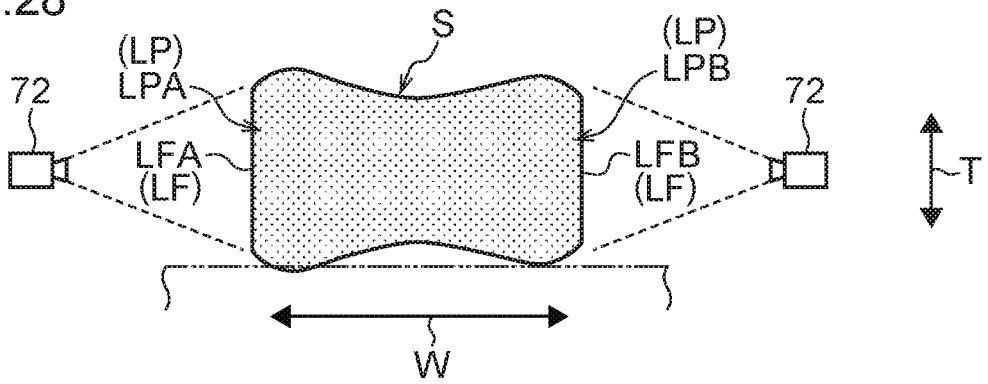
FIG. 28 is a cross-section taken along line L28-L28 of FIG. 27, and illustrates means employed to find a slab thickness variation across a slab width direction after edging.
Figure 29:
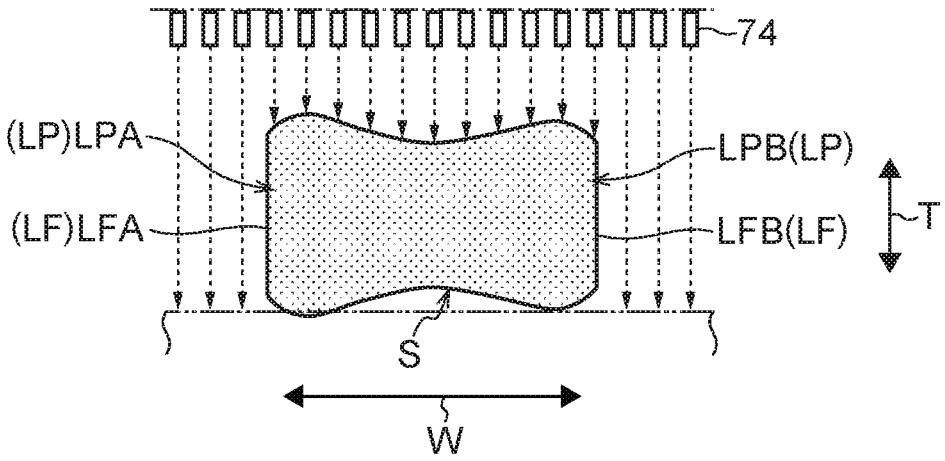
FIG. 29 illustrates a first modified example of an edging device of the fifth exemplary embodiment, and is a cross-section (a cross-section corresponding to FIG. 28) illustrating means employed to find a slab thickness variation across a slab width direction after edging.
Figure 30:
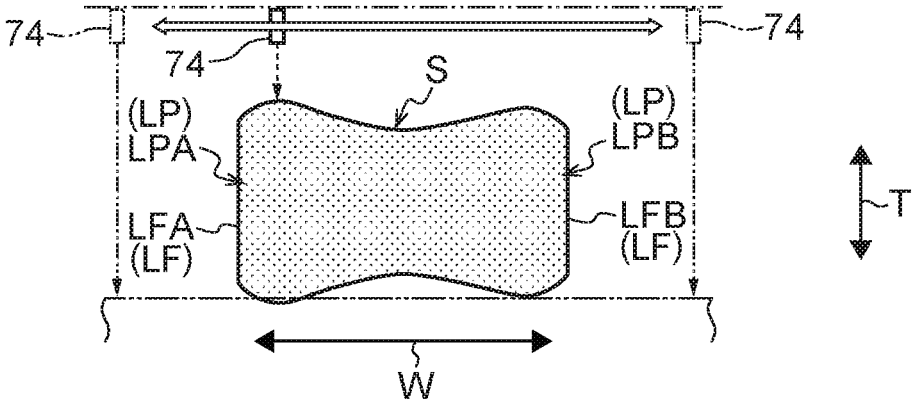
FIG. 30 illustrates a second modified example of an edging device of the fifth exemplary embodiment, and is a cross-section (a cross-section corresponding to FIG. 28) illustrating means employed to find a slab thickness variation across a slab width direction after edging.

As illustrated in FIG. 28, in the fifth exemplary embodiment, the slab thickness variation between the two lateral face portions LP on the edging output side are computed based on the image information captured by the CCD cameras 72; however, the present disclosure is not limited to such a configuration. For example, as illustrated in FIG. 29, configuration may be made in which, instead of the CCD cameras 72, plural distance sensors 74 are installed above the conveyance line L at intervals in the width direction, the distance to the upper face of the conveyed slab S is measured, and the slab thickness variation across the width direction of the slab S is computed based on the measured information. Moreover, as illustrated in FIG. 30, configuration may be made in which a moving device, not illustrated in the drawings, is employed to move a single distance sensor 74 in the width direction of the conveyance line L so as to measure the distance to the upper face of the slab S, and the slab thickness variation across the width direction of the slab S on the edging output side is computed based on the measured information.

Figure 31:
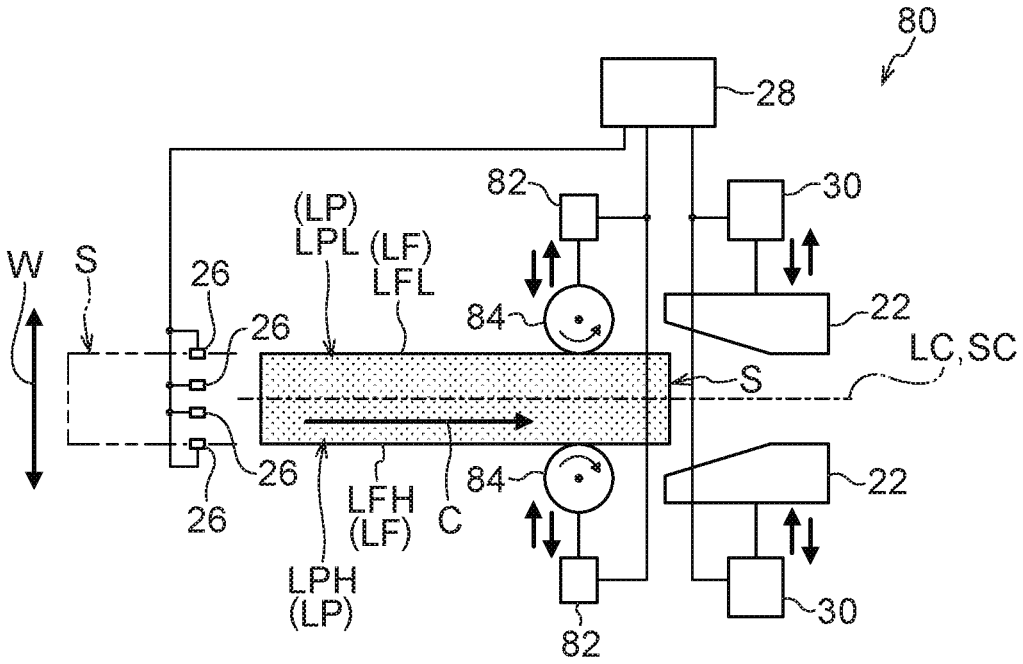
FIG. 31 is a plan view schematically illustrating a modified example of an edging device of the first exemplary embodiment.
Figure 32:
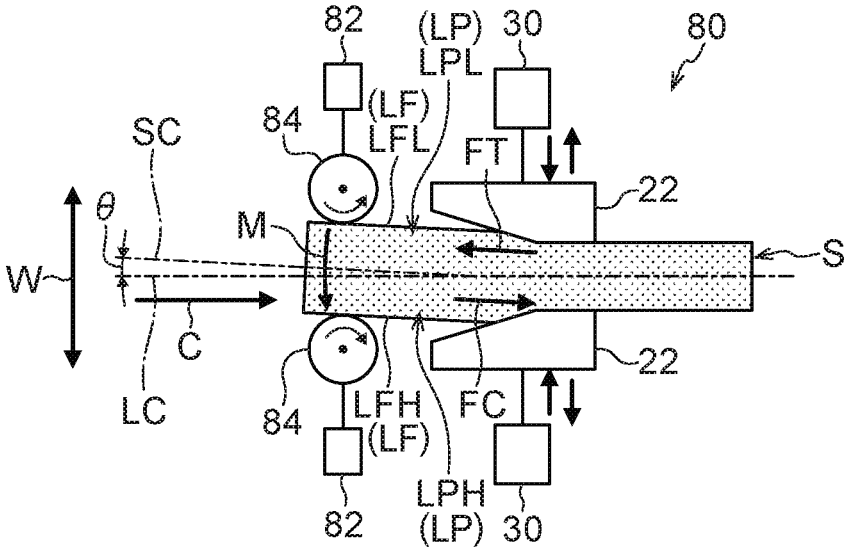
FIG. 32 is a plan view illustrating a state in which a slab sandwiched between a pair of roll members is moved in a width direction of the conveyance line to apply an incident angle to the slab in an edging method employing the edging device illustrated in FIG. 31.

In the first to the fifth exemplary embodiments, configuration is made in which the plate members 24 are employed to apply the slab S with the incident angle θ; however, the present disclosure is not limited to such a configuration. For example, configuration may be made in which, as in the edging device 80 illustrated in FIG. 31 and FIG. 32, a pair of roll members 84 are positioned on either side of the slab S, and the pair of roll members 84, capable of rotating about an axial direction running in the slab thickness direction, are employed to apply the slab S with the incident angle θ. The roll members 84 are capable of being moved in the width direction of the conveyance line L by moving mechanisms 82 that are controlled by the controller 28. When such rotatable roll members 84 are employed, the moving mechanisms 82 are not required to tilt the roll members 84 with respect to the conveyance line L, thereby simplifying the configuration. Moreover, friction between the roll members 84 and the slab S is suppressed since the roll members 84 can be turned by drag of the slab S that is being conveyed.

In the first to the fifth exemplary embodiments, configuration is made in which the pressing mechanisms 30 that move the pair of edging members 22 in the width direction are controlled by the controller 28; however, the present disclosure is not limited to such a configuration. For example, configuration may be made in which the pressing mechanisms 30 are controlled by another controller separate to the controller 28.

Explanation has been given regarding several exemplary embodiments of the present disclosure; however, the present disclosure is not limited to the above, and obviously various other modifications may be made within a range not departing from the spirit of the present disclosure. For example, the configurations of the first to the fifth exemplary embodiments may be combined as desired. Namely, the incident angle θ of the slab S may be determined using a combination of any two or more pieces of information out of the temperature distribution of the slab S prior to edging, the slab thickness variation, the variation between coefficients of friction, the camber amount of the part that has been subjected to edging, the slab thickness variation of the part that has been subjected to edging, or other information.

The exemplary embodiment described above further discloses the following items.

Item 1

An edging method including changing an incident angle of a slab with respect to a pair of edging means that are disposed on a conveyance line of the slab and that edge the slab based on information relating to the slab acquired at at least one of prior to edging or after edging.

Item 2

The edging method of item 1, wherein: the information includes a temperature distribution across a width direction of the slab prior to edging; and the incident angle of the slab is changed according to the temperature distribution.

Item 3

The edging method of item 1, wherein: the information includes a camber of the slab after edging; and the incident angle of the slab is changed according to the camber of the slab.

Item 4

The edging method of item 1, wherein: the information includes a slab thickness variation across a width direction of the slab at at least one of prior to edging or after edging; and the incident angle of the slab is changed according to the slab thickness variation.

Item 5

The edging method of item 1, wherein: the information includes a variation between coefficients of friction of both lateral faces in a width direction of the slab with respect to the edging means prior to edging; and the incident angle of the slab is changed according to the variation between the coefficients of friction.

Item 6

The edging method of any one of items 2 to 5, wherein the incident angle of the slab is also changed based on, in addition to the information, at least one of a dimension of the slab, an edging amount of the slab, or a type of steel of the slab.

Item 7

The edging method of any one of items 1 to 6, wherein the incident angle is changed by contacting a moving member capable of moving in a width direction of the slab against a lateral face in the width direction of the slab further upstream than the pair of edging means on the conveyance line.

Item 8

An edging device including: a pair of edging means that are disposed on a conveyance line of a slab, and that perform edging by pressing the slab from both sides in the width direction of the slab; a slab incident angle changing means that is disposed further upstream than the pair of edging means on the conveyance line, and that changes an incident angle of the slab; a slab information acquisition means that acquires information relating to the slab at at least one of prior to edging or after edging; and a slab incident angle control means that controls the slab incident angle changing means based on information relating to the slab acquired by the slab information acquisition means.

Item 9

The edging device of item 8, wherein: the slab information acquisition means includes a means to acquire a temperature distribution across the width direction of the slab prior to edging; and the slab incident angle control means controls the slab incident angle changing means according to the temperature distribution.

Item 10

The edging device of item 8, wherein: the slab information acquisition means includes means to acquire a camber amount of the slab after edging; and the slab incident angle control means controls the slab incident angle changing means according to the camber amount of the slab.

Item 11

The edging device of item 8, wherein: the slab information acquisition means includes means to acquire a slab thickness variation across a width direction of the slab at at least one of prior to edging or after edging; and the slab incident angle control means controls the slab incident angle changing means according to a size of the slab thickness variation.

Item 12

The edging device of item 8, wherein: the slab information acquisition means includes means to acquire a variation between coefficients of friction of both lateral faces in a width direction of the slab with respect to the edging means prior to edging; and the slab incident angle control means controls the slab incident angle changing means according to the variation between the coefficients of friction.

Item 13

The edging device of any one of items 8 to 12, wherein the slab incident angle changing means includes: a pair of roll members that are positioned on both sides of the slab and that are capable of rotating about an axial direction running in a slab thickness direction of the slab; and a moving means that moves the roll members in a width direction of the slab.

Item 14

The edging device of any one of items 8 to 12, wherein the slab incident angle changing means includes: plate members extending toward the pair of edging means and including plate faces that contact lateral faces in the width direction of the slab; and a moving means that moves the plate members in a width direction of the slab.

The invention claimed is:

1. An edging method comprising changing an incident angle of a slab having a width direction across its width with respect to a pair of edging units that are disposed on a conveyance line of the slab and that edge the slab based on information relating to the slab acquired at at least one of prior to edging or after edging, wherein:

the information includes (i) a temperature distribution across the width direction of the slab prior to edging, or (ii) a slab thickness variation across the width direction of the slab at at least one of prior to edging or after edging, or (iii) a variation between coefficients of friction of both lateral faces of the slab, which are separated by the width direction of the slab, with respect to the edging units prior to edging; and the incident angle of the slab is changed according to the temperature distribution, the slab thickness variation, or the variation between the coefficients of friction.

2. The edging method of claim 1, wherein the incident angle of the slab is also changed based on, in addition to the information, at least one of a dimension of the slab, an edging amount of the slab, or a type of steel of the slab.

3. The edging method of claim 1, wherein the incident angle is changed by contacting a moving member capable of moving in the width direction of the slab against a lateral face in the width direction of the slab further upstream than the pair of edging units on the conveyance line.

* * * * *